US008517490B2

(12) United States Patent
Kanematsu et al.

(10) Patent No.: US 8,517,490 B2
(45) Date of Patent: Aug. 27, 2013

(54) PRINTING APPARATUS AND PRINTING METHOD FOR DETERMINING A DRIVING ORDER IN ACCORDANCE WITH A DISPLACEMENT OF PRINT NOZZLES

(75) Inventors: Daigoro Kanematsu, Yokohama (JP); Yoshinori Nakajima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 110 days.

(21) Appl. No.: 13/208,711

(22) Filed: Aug. 12, 2011

(65) Prior Publication Data

US 2012/0044291 A1 Feb. 23, 2012

(30) Foreign Application Priority Data

Aug. 20, 2010 (JP) ..... 2010-185196

(51) Int. Cl.
*B41J 29/38* (2006.01)

(52) U.S. Cl.
USPC ..... 347/9; 347/12; 347/14; 347/19

(58) Field of Classification Search
USPC .... 347/9–10, 12, 40–43, 57–59; 400/120.05, 400/120.06
See application file for complete search history.

(56) References Cited

U.S. PATENT DOCUMENTS 6,439,687 B1 8/2002 Inoue
6,460,976 B1 * 10/2002 Oikawa ..... 347/57
2004/0185693 A1 9/2004 Yamaguchi et al.

FOREIGN PATENT DOCUMENTS

JP 2001-071466 A 3/2001
JP 2004-276473 A 10/2004

* cited by examiner

*Primary Examiner* — Juanita D Jackson
(74) *Attorney, Agent, or Firm* — Fitzpatrick, Cella, Harper & Scinto

(57) ABSTRACT

The present invention provides a printing apparatus and a printing method according to which, even when misalignment in mounted print heads or a print medium conveying error has occurred, a high quality image can be printed by performing one-pass printing or multi-pass printing of a time division driving method. In a case wherein a plurality of nozzles are divided into a plurality of blocks to perform time division driving method, the driving order for the plurality of nozzles in the print head is changed in accordance with a displacement of a plurality of nozzles employed to print on the same raster.

17 Claims, 20 Drawing Sheets

| PASS | PRINT HEAD H | |
|---|---|---|
| | NOZZLE ARRAY La | NOZZLE ARRAY Lb |
| FIRST PASS | A-1 | B-1 |
| SECOND PASS | A-2 | B-2 |
| THIRD PASS | A-3 | B-3 |
| ... | ... | ... |
| (N-1)TH PASS | A-N-1 | B-N-1 |
| NTH PASS | A-N | B-N |

FIG.18

PRINTING APPARATUS AND PRINTING METHOD FOR DETERMINING A DRIVING ORDER IN ACCORDANCE WITH A DISPLACEMENT OF PRINT NOZZLES

BACKGROUND OF THE INVENTION

1. Field of the Invention

The present invention relates to a printing apparatus and a printing method for employing a print head where a plurality of print elements are arranged and printing an image on a print medium.

2. Description of the Related Art

Generally, a so-called serial scan ink jet printing apparatus includes a carriage on which a print head serving as printing means is mounted, a conveying unit for conveying a print medium, and a controller for controlling these components. For printing an image on the print medium, the printing apparatus repeats a printing operation, for ejecting ink through a plurality of nozzles in the print head while moving the print head in the main scan direction, and an operation for conveying the print medium in the sub-scan direction crossing the main scan direction. Ejection energy generation elements, such as electrothermal transducing elements or piezoelectric elements, are provided for the individual nozzles, and when the ejection energy generation elements are driven, ink is ejected through ejection ports formed at the tips of the nozzles. The nozzles serve as printing elements for applying ink to the print medium.

An example driving method for the print head is a time division driving method (block driving method) for employing time division for a plurality of nozzles for each block. For example, for a print head wherein 128 nozzles of nozzle numbers 1 to 128 are formed into arrays in the main scan direction, which is perpendicular to the sub-scan direction, the 128 nozzles are divided into eight blocks from the first to the eighth, and nozzles of nozzle numbers 1, 9, 17, . . . and 121 are assigned to the first block. Similarly, the nozzles of nozzle numbers 2, 10, 18, . . . and 122 are assigned to the second block, the nozzles of nozzle numbers 3, 11, 19, . . . and 123 are assigned to the third block, and the nozzles of nozzle numbers 4, 12, 20, . . . and 124 are assigned to the fourth block. The same assignment is performed for the fifth to the eighth blocks. Assume that, using this print head, a ruled line having a width equivalent to one dot in the sub-scan direction was printed at a resolution of 1200 dpi in the main scan direction. In this case, due to a drive time difference for the first to the eighth blocks, the landing positions of ink droplets ejected from the nozzles assigned to the individual blocks would deviate in the main scan direction. Thus, when ink is ejected from the nozzles of nozzle number 1 and nozzle number 8, the landing positions of ink droplets deviate, in the main scan direction, a distance of 21 μm which is equivalent to about $1/1200$ dpi.

This deviation in the landing positions is seldom identified as an image defect in a case wherein only a single print head is employed to print a single-color image by a one-pass printing method for scanning a predetermined print area by moving the print head one time. However, in a case wherein a plurality of print heads are employed to print an image by a multi-pass printing method for scanning a predetermined print area by moving the print heads a plurality of times, one raster image is printed using a plurality of different nozzles, and therefore a belt-shaped density unevenness would appear.

Assume that image printing was performed by the multi-pass printing method while employing two print heads, and that because of a printing head mounting error, the landing positions of ink droplets ejected from the nozzles of the print heads were displaced, a distance equivalent to one pixel in a direction in which the nozzles are arrayed (sub-scan direction). In this case, combination blocks, to which the nozzles of the two print heads for forming dots on a single raster belong, are changed. When the nozzles for forming dots on the single raster belong to different blocks, the landing positions of the ink ejected from these nozzles deviate relative to each other, and the overlapping states of dots formed by the ink are varied. When the overlapping states of the dots are varied, the density of a printed image is changed in accordance with a block drive period.

In Japanese Patent Laid-Open No. 2001-071466, a construction for multi-pass printing is described wherein a plurality of nozzles used for printing the identical raster are driven at two or more different block drive timings. Also, in Japanese Patent Laid-Open No. 2001-071466, a method is described for proportionally distributing drive blocks to individual rasters. Specifically, numbers indicating the order for driving are provided for the individual blocks, and, for all of the rasters, the same value is set as the total of the numbers for the blocks to which the nozzles employed for printing a single raster belong. Furthermore, in Japanese Patent Laid-Open No. 2004-276473, a method is described according to which, for an elongated print head (a connecting head) including a plurality of small print heads partly overlapped in the sub-scan direction, the identical block is set for the nozzles in the overlapping portions of the elongated print head.

However, the technique in Japanese Patent Laid-Open No. 2001-071466 is assumed for multi-pass printing and is not compatible with one-pass printing that employs a plurality of print heads, and further there is no description given concerning mounting errors in the print heads. In addition, in Japanese Patent Laid-Open No. 2004-276473, there is no description given concerning mounting errors in the print heads and multi-pass printing.

SUMMARY OF THE INVENTION

The present invention provides a printing apparatus and a printing method for obtaining an image at high quality by performing one-pass printing or multi-pass printing in a time division driving method, even when there is a deviation in the mounted positions of print heads, or an error occurring during the conveying of a print medium.

In the first aspect of the present invention, there is provided a printing apparatus for printing an image on a print medium by employing at least one print head including a printing element array formed of a plurality of printing elements, the plurality of printing elements of the print head being divided into a plurality of driving blocks and driven by a time division drive method during movement of the print head relative to a print medium in a direction crossing the printing element array, the printing apparatus comprising:

a control unit configured to print on the same raster area of the print medium by employing at least two printing elements of the print head, the same raster extending in a direction crossing the printing element array; and a changing unit configured to change a driving order for the plurality of printing elements based on a displacement, in a direction of the printing element array, between at least two print elements employed to print on the same raster.

In the second aspect of the present invention, there is provided a printing method for printing an image on a print medium by employing at least one print head including a printing element array formed of a plurality of printing elements, the plurality of printing elements of the print head being divided into a plurality of driving blocks and driven by a time division drive method during movement of the print head relative to a print medium in a direction crossing the printing element array, the printing method comprising the steps of:

printing on the same raster of the print medium by employing at least two printing elements of the print head, the same raster extending in a direction crossing the printing element array; and changing a driving order for the plurality of printing elements based on a displacement, in a direction of the printing element array, between at least two print elements employed to print on the same raster.

According to the present invention, when a plurality of printing elements forming a printing element array are divided into a plurality of blocks for performing time-division driving, the order for time-division driving of the printing elements of the printing element array is changed depending on a deviation in the positions of the printing elements employed for printing the same raster image. As a result, when the positions of the printing elements employed to print the same raster image are changed, due to an error in the mounting positions of the print heads or a difference in the position of the print medium that is being conveyed, a displacement in the landing positions of ink droplets ejected through these printing elements, for the same raster, is as small as possible, and high quality printing can be performed.

Further features of the present invention will become apparent from the following description of exemplary embodiments (with reference to the attached drawings).

BRIEF DESCRIPTION OF THE DRAWINGS

FIG. 18 is an explanatory diagram showing a table for setting the block driving order according to the fourth embodiment of the present invention;

DESCRIPTION OF THE EMBODIMENTS

The embodiments of the present invention will now be described while referring to the accompanying drawings. The embodiments in the following description employ an ink jet printing apparatus using ink jet print heads wherein a plurality of nozzles (printing elements) are arranged to form a nozzle array (printing element array).

First Embodiment

Figure 1:
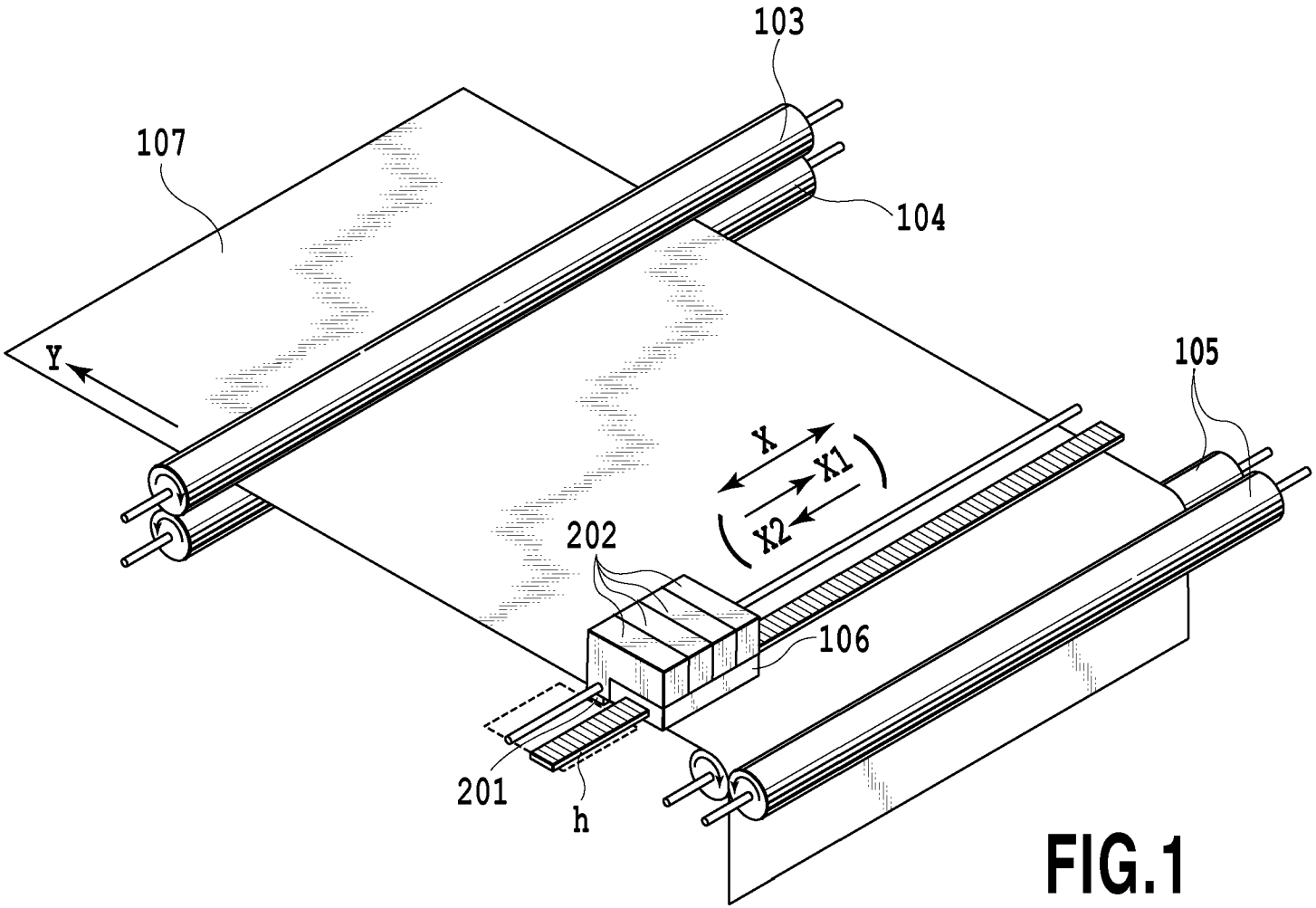
FIG. 1 is a schematic perspective view of an ink jet printing apparatus for which the present invention can be applied.

FIG. 1 is a schematic perspective view of a configuration example of an ink jet printing apparatus (printer) for which the present invention can be applied. Four ink jet cartridges 202 respectively include ink tanks, in which differently colored inks (black, cyan, magenta and yellow) are stored, and print heads 201 that can eject ink supplied from the ink tanks. A feed roller 103 and an auxiliary roller 104 rotate together in respective directions indicated by arrows, while holding a print sheet (print medium) 107, and convey the print sheet 107 in a sub-scan direction indicated by an arrow Y. A carriage 106, on which the four ink jet cartridges 202 are detachably mounted, is moved in a main scan direction indicated by an arrow X. The main scan direction crosses (in this embodiment, is perpendicular to) the sub-scan direction. In the individual print heads 201, a plurality of nozzles, through which ink is ejected, are arranged as printing elements in a direction that crosses (in this embodiment, is perpendicular to) the sub-scan direction. When printing by the ink jet printing apparatus is not to be performed, or when a recovery operation is to be performed for the print heads, the carriage 106 is moved to and remains at a home position, described by broken lines in FIG. 1.

Before the printing operation is performed, the carriage 106 is located at the home position described by the broken lines in FIG. 1. When a printing start instruction is received, the carriage 106 is moved in the forward scan direction indicated by an arrow X1, and ink is ejected through the nozzles in the print heads 201. As a result, an image is printed in an area on the print sheet 107 that corresponds to the nozzle array (the printing width) of the print head 201. Then, when one scan has been completed, the carriage 106 is returned to the home position. Thereafter, the carriage 106 is again moved in the forward scan direction indicated by the arrow X1, and ink is ejected from the print heads 201 to perform the next printing. In the period extending from the end of the preceding scan until the start of the next scan, the feed roller 103 and the auxiliary roller 104 are rotated in the respective directions indicated by the arrows and convey the print sheet 107 a predetermined distance. When the scan and the conveying of the print sheet 107 are repeated in this manner, an image is sequentially printed on the print sheet 107. The printing operation for the ejection of ink from the print heads 201 is controlled by a printing controller (not shown). In order to increase the printing speed, printing may be performed not only when the carriage 106 is moved in the forward scan direction, but also when the carriage 106 is moved in the backward scan direction indicated by an arrow X2.

Figure 2:
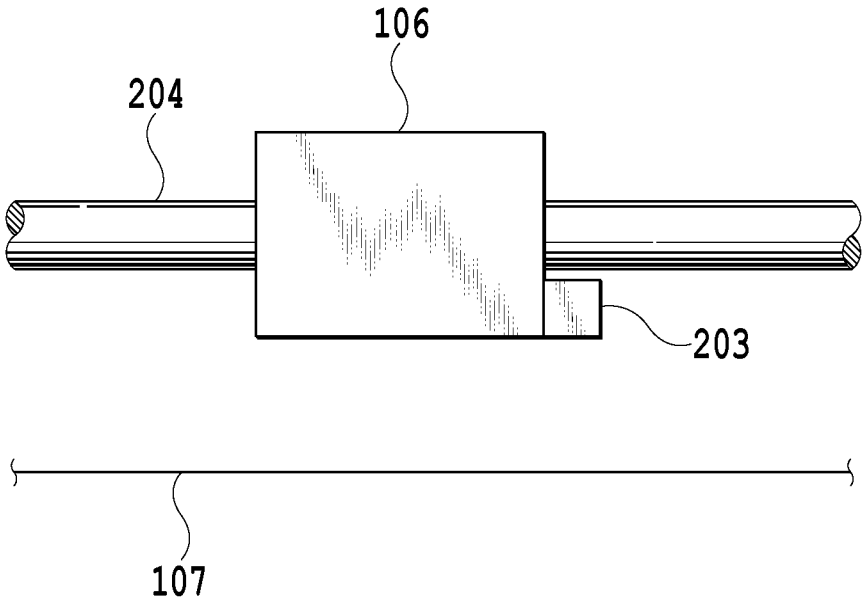
FIG. 2 is an explanatory diagram showing an optical sensor included in the ink jet printing apparatus in FIG. 1.

FIG. 2 is an explanatory diagram showing an optical sensor 203 provided on a side face of the carriage 106. When a test pattern has been printed on the print sheet 107 in order to obtain an adjustment value for timing employed for the ejection of ink from the print heads 201, the optical sensor 203 is moved together with the carriage 106 and reads the test pattern to obtain the adjustment value. Further, as a platen gap, the optical sensor 203 also detects a distance between the nozzle faces (faces in which the ejection ports are formed) of the print heads 201 and the print sheet 107.

Figure 3:
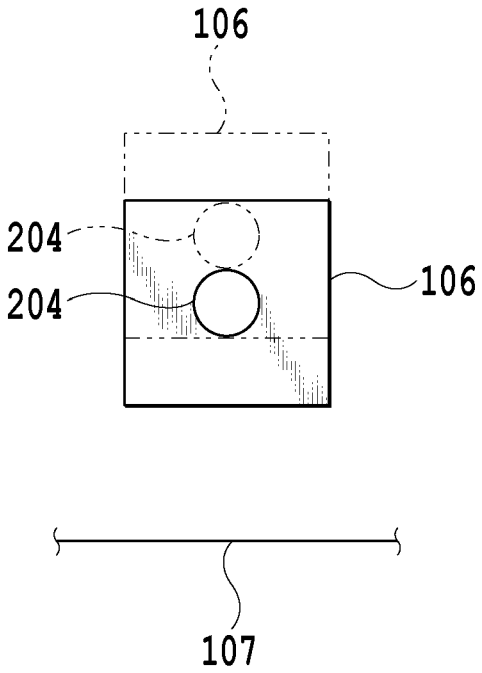
FIG. 3 is a diagram for explaining a platen gap change mechanism included in the ink jet printing apparatus in FIG. 1.

FIG. 3 is a diagram for explaining a mechanism that changes a distance (platen gap) between the print heads 201 and the print sheet 107. According to the example, a platen gap is changed by a mechanism (not shown) that elevates or lowers a carriage rail 204 supporting the carriage 106. The carriage rail 204 is moved up or downed in accordance with the thickness or type of print sheet 107 or the temperature or humidity of the environment. With this structure, an optimal distance between the print heads 201 and the print sheet 107 can be maintained, and rubbing of the print heads 201 against the print sheet 107 and the resulting degradation of the image quality can be prevented.

The ink tanks used to store ink for printing and the print heads 201 ejecting ink onto the print sheet 107 may be assembled to form a single integrated ink jet cartridge, or may be mounted as separate units on the carriage 106. Furthermore, a single print head that can eject a plurality of ink colors (a multi-color print head) may be employed.

A capping unit (not shown) for covering the front face (in which the ejection ports are formed) of the print head is provided at a location where a recovery operation is performed for the print head. Further, a recovery unit (not shown) is provided to perform a recovery operation, such as the removal of viscous ink and of bubbles in the print head covered by the capping unit. Furthermore, a cleaning blade (not shown), for example, is supported on the side of the capping unit so that the cleaning blade can be projected toward and be brought into contact with the front face of the print head. With this arrangement, after the recovery process has been performed for the print head, by projecting the cleaning blade into the travel path of the print head and moving the print head, unnecessary ink droplets and dirt can be removed from the front face of the print head.

Figure 4:
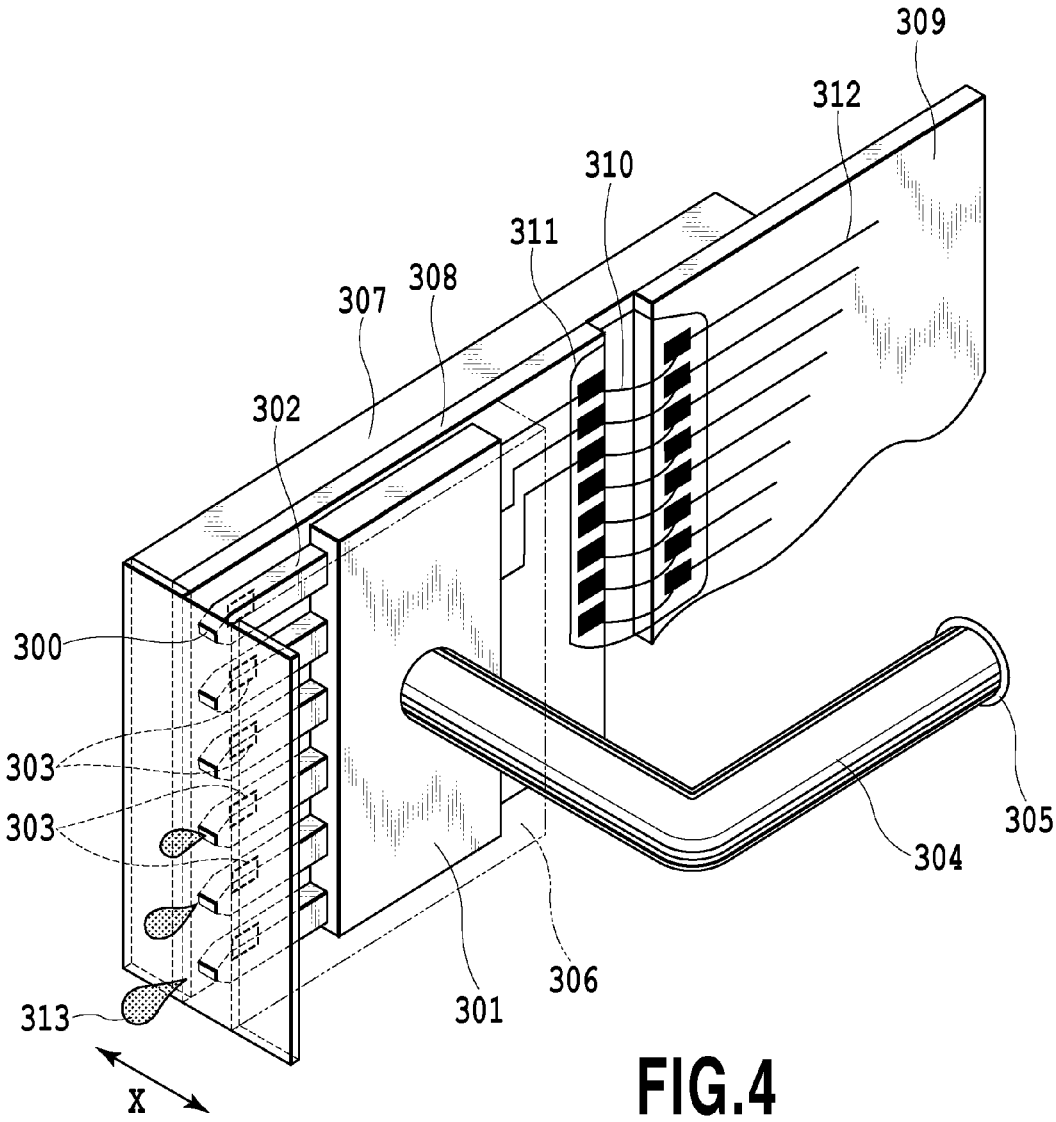
FIG. 4 is a perspective view of the essential portion of a print head that can be mounted on the ink jet printing apparatus in FIG. 1.

FIG. 4 is a perspective view of an essential portion of the individual print heads 201. For each of the print heads 201, a plurality of ejection ports 300 are formed at predetermined pitches, and are connected to a common liquid chamber 301 via liquid paths 302. Ejection energy generating elements 303 for generating energy for ejecting ink are arranged in the individual liquid paths 302. The ejection energy generating elements 303 and a control circuit thereof are packaged on a silicon board using a semiconductor manufacturing technology. In this embodiment, as the ejection energy generating elements 303, electrothermal transducing elements (heaters) are arranged along the walls of the liquid paths 302. The liquid paths 302, the ejection ports 300 and the ejection energy generating elements (hereinafter referred to as "heaters") 303 constitute the nozzles that are employed for ejecting ink. Further, a temperature sensor (not shown) and a sub-heater (also not shown) are also formed on the same silicon board by performing the same semiconductor manufacturing process.

A silicon plate 308 used for the above described silicon board is adhered to an aluminum base plate 307 for heat dissipation. A circuit connector 311 on the silicon plate 308 and a printed board 309 are connected by super-ultra-fine wires 310, and a signal from the main body of the printing apparatus is received by the circuit connector 311 via a signal circuit 312. The liquid paths 302 and the common liquid chamber 301 are formed by a plastic cover 306 provided by injection molding. The common liquid chamber 301 is connected to the previously described ink tank via a joint pipe 304 and an ink filter 305 so that ink is supplied from the ink tank to the common liquid chamber 301. When ink from the ink tank is supplied and temporarily stored in the common liquid chamber 301, the ink is introduced to the liquid path 302 by capillary action to form a meniscus on the ejection port 300, so that the liquid path 302 is filled with ink. In this state, when the heater 303 is rendered active via an electrode (not shown) and generates heat, ink on the heater 303 is instantaneously heated and bubble is generated in the liquid path 302, and as the bubble expands, ink droplet 313 is ejected through the ejection port 300.

Figure 5:
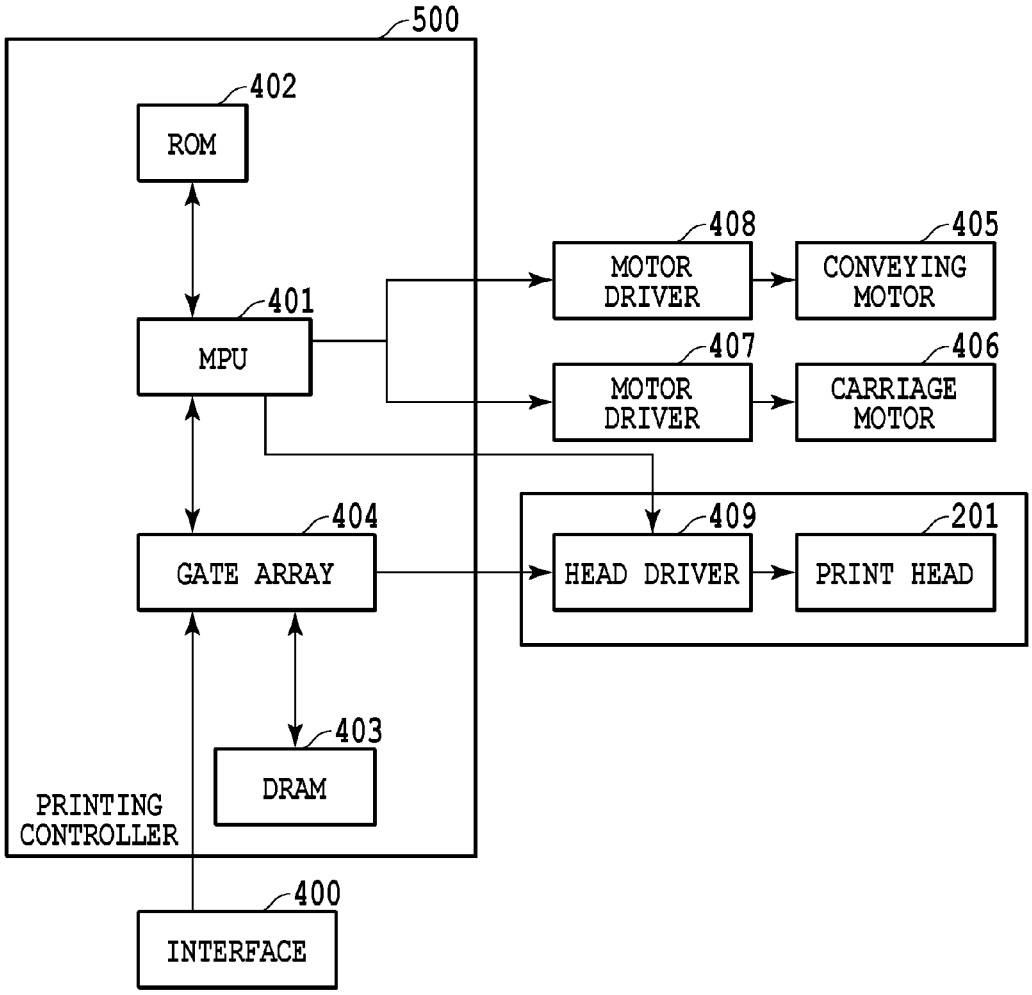
FIG. 5 is a block diagram illustrating the arrangement of the control system of the ink jet printing apparatus in FIG. 1.

FIG. 5 is a block diagram illustrating an arrangement of a control system for this printing apparatus. An interface 400 is used to receive a print signal from a host apparatus. A program ROM 402 is used to store a control program executed by an MPU 401. A dynamic RAM (DRAM) 403 is used to store various types of data, such as a print signal and print data to be transmitted to print heads. The dynamic RAM 403 can also be used for the storage, for example, of the number of dots to be formed using ink droplets that land on the print sheet and the number of replacement of the print head. A gate array 404 controls the supply of print data to the print head, while also controlling the transfer of data amongst the interface 400, the MPU 401 and the DRAM 403. A conveying motor (LF motor) 405 is provided for conveying the print sheet 107, while a carriage motor (CR motor) 406 is provided for moving the carriage 106. A motor driver 408 drives the conveying motor 405, while a motor driver 407 drives the carrier motor 406. A head driver 409 is provided for driving the print head 201, and can be mounted on a board integrated with the print head 201.

In this embodiment, as will be described later, a detection process is performed to obtain a deviation, in the nozzle array direction, of the landing position of the ink ejected from a second print head relative to the reference landing position of the ink ejected from a first print head. Then, based on the thus obtained deviation, the driving order is changed for blocks of the second print head to reduce the displacement of the landing position of ink caused by time-division driving of the print head, and to reduce the occurrence of belt-shaped density unevenness in a printed image and the degradation of the granularity of the printed image.

Figure 6:
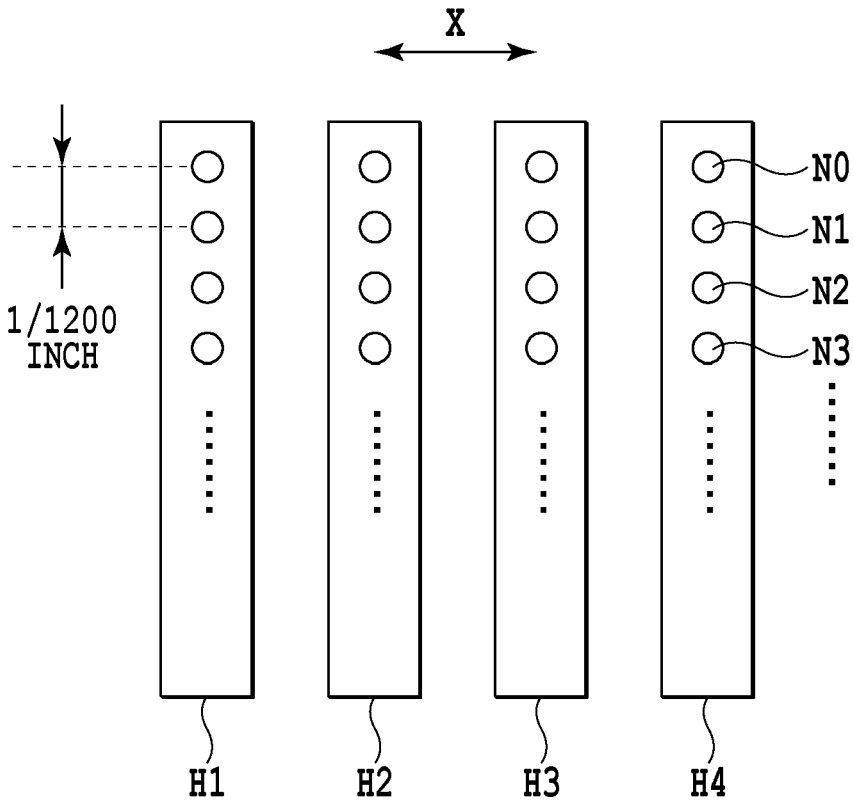
FIG. 6 is an explanatory diagram illustrating print heads mounted to a printing apparatus according to a first embodiment of the present invention.

FIG. 6 is an explanatory diagram for the print heads in this embodiment. A print head H1 is provided for the ejection of black ink, a print head H2 is provided for the ejection of cyan ink, a print head H3 is provided for the ejection of magenta ink and a print head H4 is provided for the ejection of yellow ink. These print heads H1 to H4 are mounted on separate chips. On the each individual chip, a plurality of nozzles N0, N1, N2 . . . are arranged as array at intervals of 1/1200 inch. Referring to FIG. 6, each of the print heads is detachably mounted on the carriage 106 so as to extend in a direction that crosses (in this embodiment, is perpendicular to) the main scan directions indicated by the arrow X. The nozzle array direction for each of the print heads crosses (in this embodiment, is perpendicular to) the main scan directions indicated by the arrows X. In this embodiment, it is assumed that when the print heads H1 to H4 are mounted on the carriage 106, there is a case wherein the print heads H1 to H4 are displaced in the nozzle array direction. In this embodiment, the print head H1 is regarded as a first print head, and the print heads H2, H3 and H4 are regarded as second print heads. The landing positions for ink ejected by the first print head are employed as reference positions for adjusting, in the nozzle array direction, the landing positions for ink ejected by the second print heads (this process is also called a registration adjusting process). In order to adjust the landing positions, the time-division driving order for the blocks of the print heads is changed, as will be described later.

Figure 7:
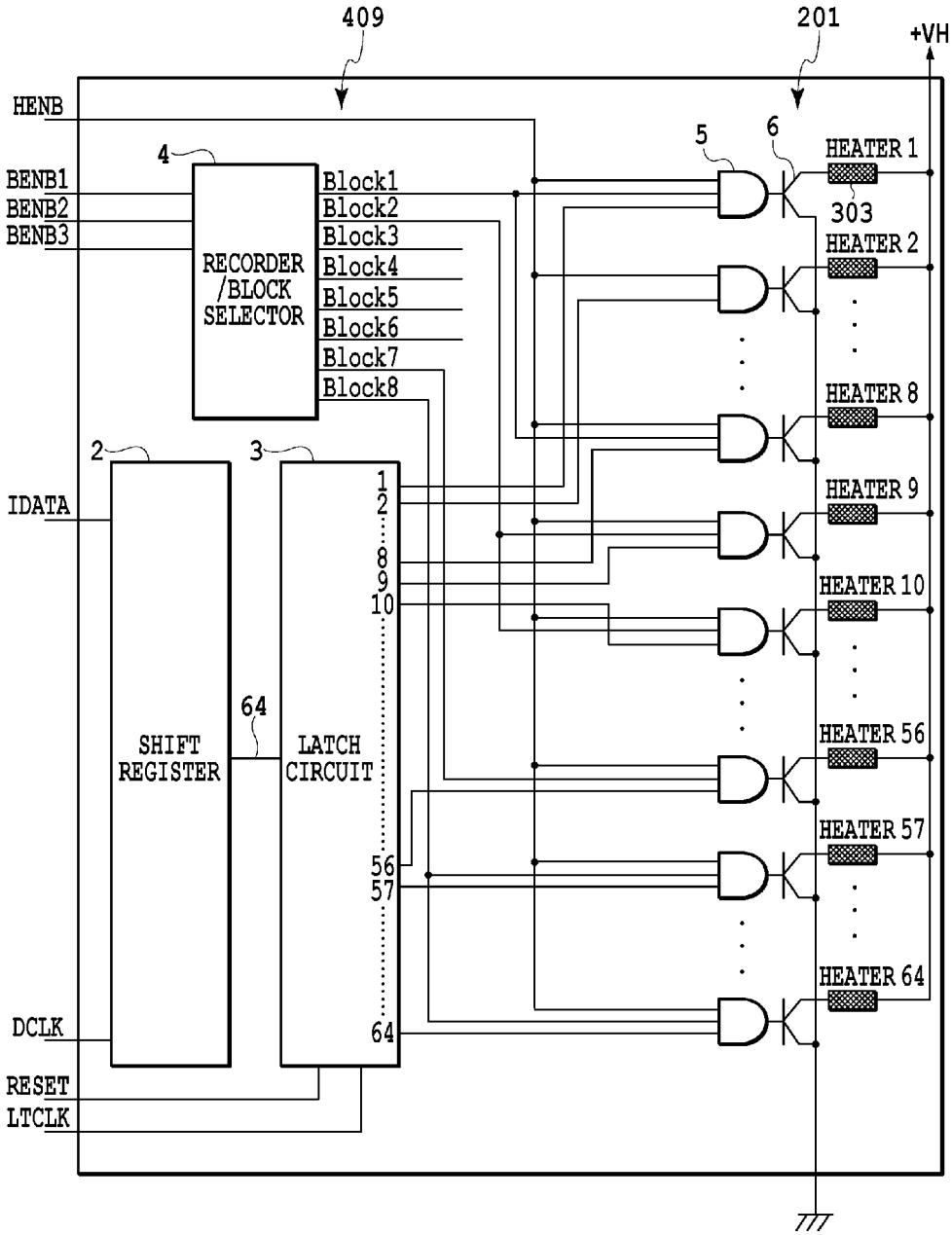
FIG. 7 is a diagram for explaining an example structure for a block drive circuit for nozzles.

FIG. 7 is a diagram for explaining an example structure for a block drive circuit for nozzles.

The head driver 409, mounted on a board together with the print heads 201, includes a shift register 2, a latch circuit 3, a block selection recorder 4, AND gates 5 and drive transistors 6. The drive transistors are connected to the heaters 303 prepared for the individual nozzles. In this embodiment, 64 nozzles corresponding to a heater 1 to a heater 64 are divided into eight blocks (Block 1 to Block 8). In synchronization with a clock signal DCLK, data IDATA to be printed are transmitted serially to the shift register 2, and are transferred to and stored by the latch circuit 3. When the shift register 2 receives print data to be printed by one printing scan and when the latch circuit 3 receives a latch signal LTCLK, the latch circuit 3 outputs the stored print data to the AND gates 5.

The print data transmitted to the AND gates 5 are distributed to corresponding transistors 6, in accordance with a block selection signal BENB1, BENB2 or BENB3 and an enable signal HENB. The block selection signals BENB1, BENB2 and BENB3 are transmitted to the block selection recorder 4, and are decoded to obtain block selection signals Block 1 to Block 8. One of the block selection signals Block 1 to Block 8 goes to high, in accordance with the values of the three block selection signals BENB1, BENB2 and BENB3, and are transmitted to the AND gates 5. Through this operation, 64 nozzles can be divided into eight blocks, and the blocks can be sequentially driven. Further, the enable signal HENB received in the AND gates 5 can be employed to control the timing for driving the drive transistors 6. The time-division driving order for the blocks of the print heads can be changed in accordance with the block selection signals BENB1, BENB2 and BENB3 received from the printing controller 500 (see FIG. 5) of the printing apparatus, as will be described later.

Figure 8:
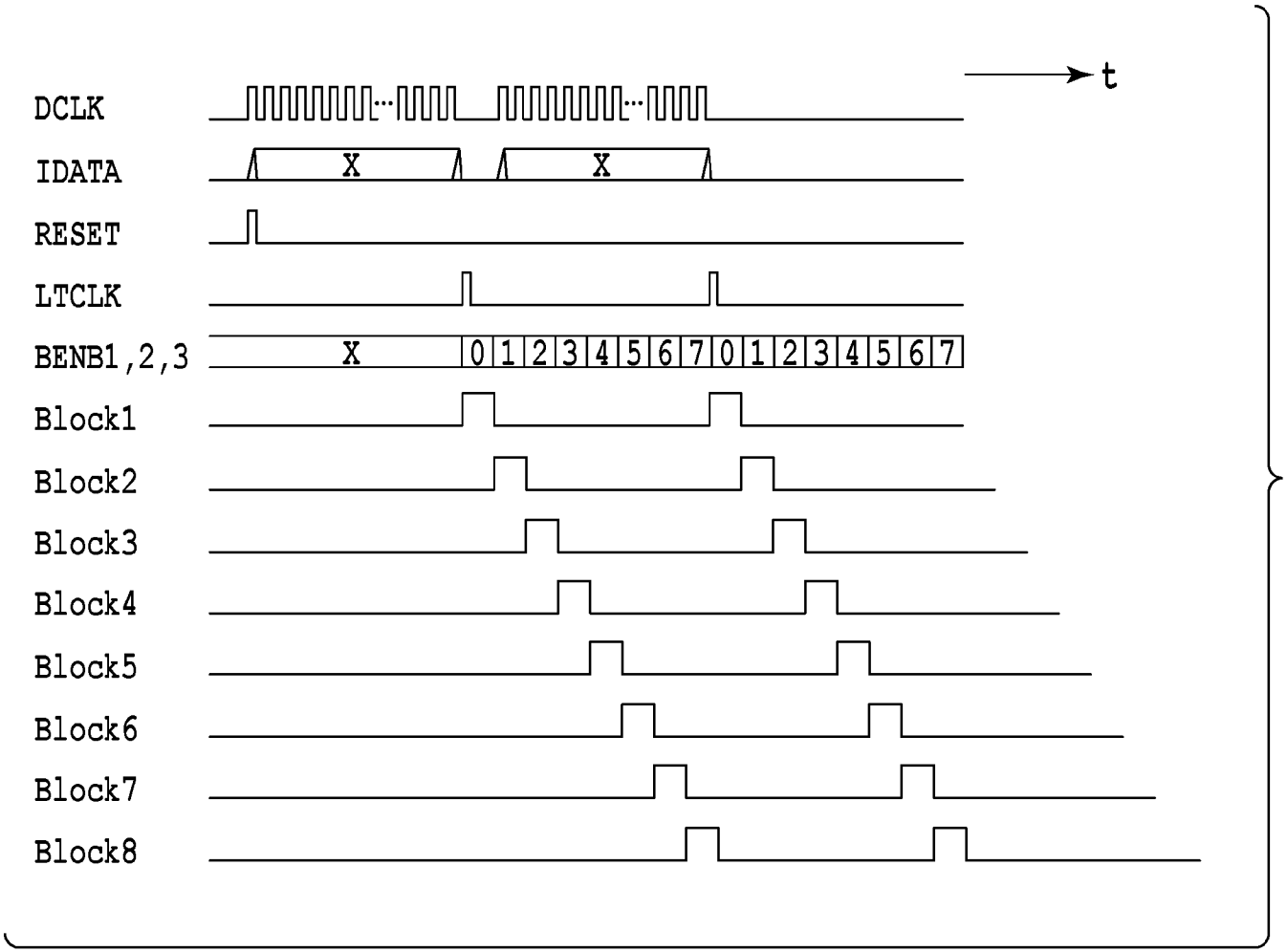
FIG. 8 is a timing chart for explaining the operation of the block drive circuit in FIG. 7.

FIG. 8 is a timing chart for explaining the operation performed by such a block drive circuit.

The AND gates 5 calculate logical products for the print data output by the latch circuit 3, the block selection signals Block 1 to Block 8 and the enable signal HENB, and output the logical products to the drive transistors 6. Since the print data is output to the drive transistor 6, a drive voltage VH is applied to the heater corresponding to the drive transistor 6. In this manner, the heaters 1 to 64 are selectively driven, and ink is ejected from the corresponding nozzle.

Figure 9A:
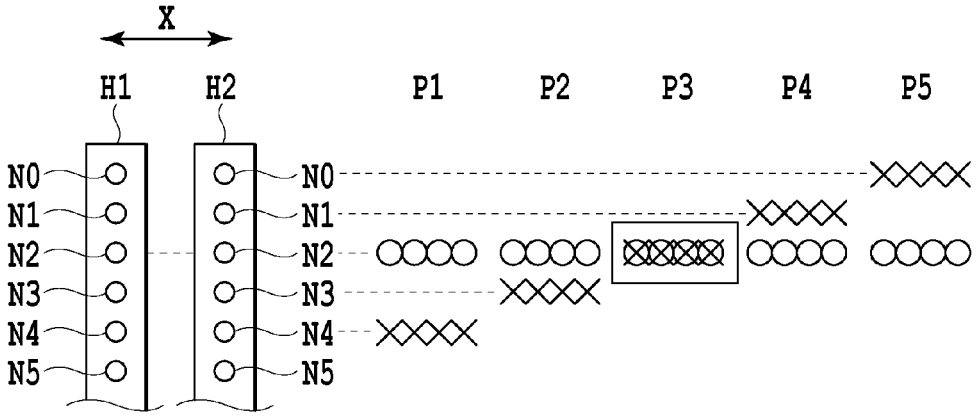
FIGS. 9A and 9B are diagrams for explaining an adjustment pattern that is printed to detect the amount of displacement in the landing positions of ink droplets.
Figure 9B:
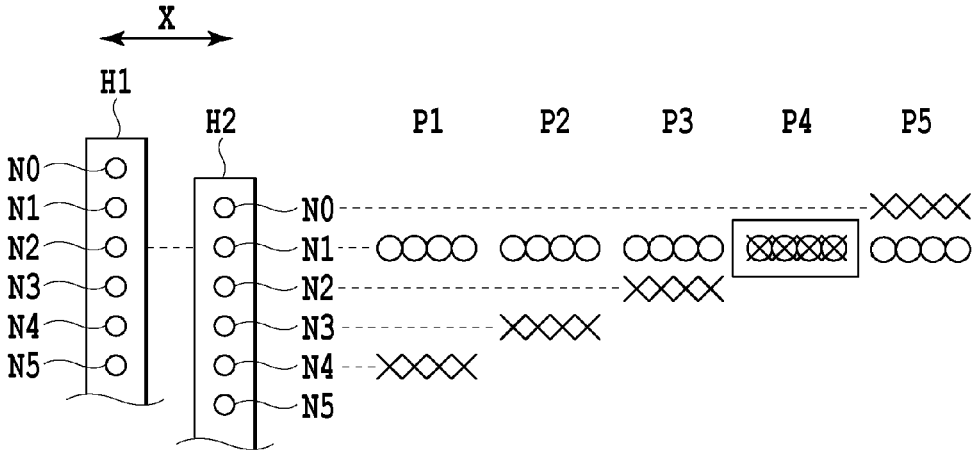

FIGS. 9A and 9B are diagrams for explaining an adjustment pattern (a test pattern) used for detecting the amount of displacement in the landing positions of ink in the nozzle array direction.

The adjustment pattern is employed for detecting the amount of displacement, in the nozzle array direction, of the landing positions of ink ejected from the second print heads relative to the landing positions of ink ejected from the first print head, i.e., for detecting the amount of displacement of the nozzles of the second print heads relative to the nozzles of the first print head. In FIGS. 9A and 9B, the adjustment pattern is employed to detect the displacement of the positioning of the nozzles of the print head H2 (the landing positions of the ink) relative to the positioning of the nozzles of the print head H1 (a reference print head) (the landing positions of ink). In this example, a pattern P3 is printed by ejecting ink droplets, indicated by "o", through the nozzle N2 of the print head H1 and by ejecting ink droplets, indicted by "X", through the nozzle N2 of the print head H2, and is regarded as a pattern having a displacement of "0". A pattern P2 is printed by ejecting ink droplets through the nozzle N2 of the print head H1 and ink droplets through the nozzle N3 of the print head H2, and is regarded as a pattern having a displacement of "+1". Likewise, a pattern P1 is printed by ejecting ink through the nozzle N2 of the print head H1 and ink through the nozzle N4 of the print head H2, and is regarded as a pattern having a displacement of "+2". Further, a pattern P4 is printed by ejecting ink through the nozzle N2 of the print head H1 and through the nozzle N1 of the print head H2, and is regarded as a pattern having a displacement of "−1". A pattern P5 is printed by ejecting ink through the nozzle N2 of the print head H1 and the nozzle N0 of the print head H2, and is regarded as a pattern having a displacement of "−2". The adjustment pattern (test pattern) employed for detecting the amount of displacement in the landing positions of ink in the nozzle array direction includes such test patterns 1 through 5.

In a case, as shown in FIG. 9A, wherein the print head H2 is not shifted away from the print head H1 in the nozzle array direction, the density of the printed pattern P3 is greatly different from the densities of the other patterns, and a displacement of "0" can be detected. In a case, as shown in FIG. 9B, wherein the print head H2 is shifted away from the print head H1 a distance equivalent to one nozzle in the nozzle array direction, the density of the printed pattern P4 is greatly different from the densities of the other patterns, and a displacement of "−1" can be detected.

Figure 10A:
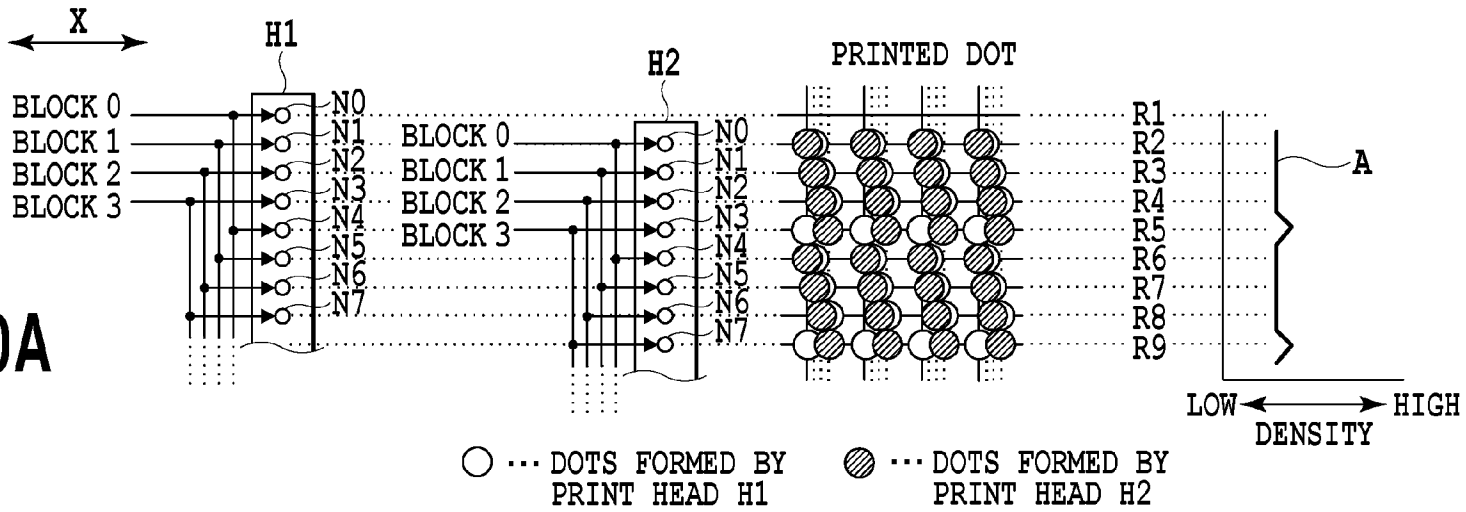
FIGS. 10A and 10B are explanatory diagrams showing landing positions for ink according to the first embodiment of the invention, before and after the order for driving blocks is changed.

FIG. 10A is a diagram for explaining the landing positions of ink when the print head H2 was shifted away from the print head H1 a distance equivalent to one nozzle in the nozzle array direction, and the blocks of the print heads H1 and H2 were driven in the same order. In this example, the nozzles of the individual print heads H1 and H2 are divided into four blocks 0, 1, 2 and 3. Nozzles N0, N4, N8, . . . are allocated to block 0, nozzles N1, N5, N9, . . . are allocated to block N1, nozzles N2, N6, N10, . . . are allocated to block 2, and nozzles N3, N7, N11, . . . are allocated to block 3. The nozzles allocated to the blocks 0, 1, 2 and 3 are driven in the same order as the blocks 0, 1, 2 and 3. Therefore, the displacement distance between the actual landing position of ink ejected from a nozzle and the ideal ink landing position becomes larger as the driving order of the nozzle increases (as the nozzle is driven later in time).

Since the print head H2 does not have a nozzle corresponding to a raster R1, the nozzle N0 (the first nozzle) of the print head H1 becomes an unused nozzle at the time scanning is performed for printing the leading portion of the image. However, when print data are present for the following scanning process, the nozzle N0 of the print head H1 is employed. The print head H1 employs the nozzles in the block 1 to form ink dots for a raster R2, and employs the nozzles in the block 2 to form ink dots for a raster R3. Further, the print head H1 employs the nozzles in the block 3 to form ink dots for a raster R4, and employs the nozzles in the block 0 to form ink dots for a raster R5. The print head H2 employs the nozzles in the block 0 to form ink dots for the raster R2, and employs the nozzles in the block 1 to form ink dots for the raster R3. Furthermore, the print head H2 employs the nozzles in the block 2 to form ink dots for the raster R4, and employs the nozzles in the block 3 to form ink dots for the raster R5.

Therefore, for forming ink dots for a single raster, different blocks to which nozzles belong are driven for the print heads H1 and H2. As a result, a dot coverage rate (an area factor) of a print medium is changed due to a displacement in the landing positions of the ink ejected from the print heads H1 and H2, and an uneven density distribution A appears for the printed image in the nozzle array direction. Since the uneven density distribution A is present in the nozzle array direction, a belt-shaped density unevenness will occur in the printed image.

Figure 10B:
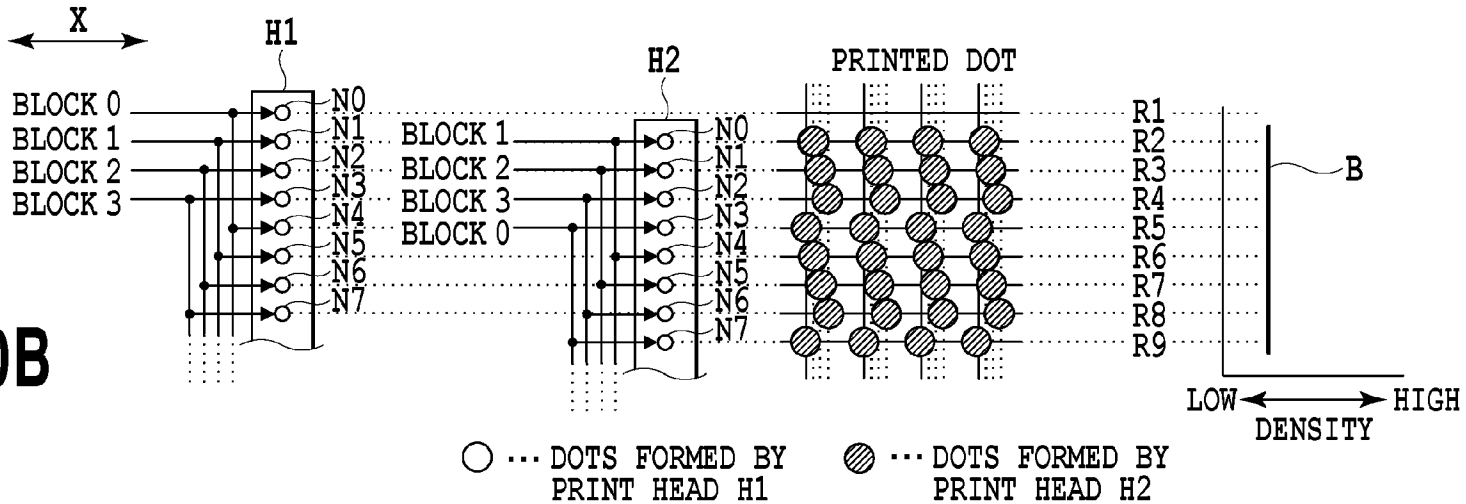

In this embodiment, as shown in FIG. 10B, the order in which blocks are driven is changed in accordance with the degree of misalignment of the print heads H1 and H2 in the nozzle array direction. That is, based on the printed adjustment pattern (a test pattern) described previously, the amount of positional deviation between the print heads H1 and H2 in the nozzle array direction is detected, and is employed to change the order in which the blocks are driven.

In FIG. 10B, the print head H1 employs the nozzles in the block 1 to form ink dots for the raster R2, and employs the nozzles in the block 2 to form ink dots for the raster R3. Further, the print head H1 employs the nozzles in the block 3 to form ink dots for the raster R4, and employs the nozzles in the block 0 to form ink dots for the raster R5. The print head H2 employs the nozzles in the block 1 to form ink dots for the raster R2, and employs the nozzles in the block 2 to form ink dots for the raster R3. Furthermore, the print head H2 employs the nozzles in the block 3 to form ink dots for the raster R4 and employs the nozzles in the block 0 to form ink dots for the raster R5.

Therefore, for forming ink dots for the same raster (the same raster area), the same blocks to which the nozzles belong are driven for the print heads H1 and H2. As a result, the landing positions of ink ejected from the two print heads are identical and the dot coverage rate (an area factor) for a print medium is constant, and a uniform density distribution B, in the nozzle array direction, is obtained for a printed image. Since the density distribution B is uniform, the occurrence of the belt-shaped density unevenness, as shown in FIG. 10A, can be avoided.

In this embodiment, the order in which blocks are driven is changed in accordance with the degree of misalignment, in the nozzle array direction, of the print heads H1 and H2. Similarly, the print head H1 can be employed as a reference to change the order in which the blocks of the print heads H3 and H4 are driven.

Figure 11A:
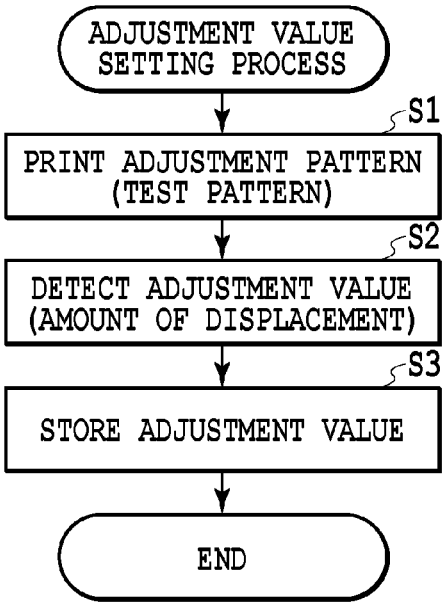
FIGS. 11A and 11B are flowcharts for explaining the processing for setting an adjustment value and the printing operation according to the first embodiment of the present invention.

FIG. 11A is a flowchart for explaining the processing performed to set an adjustment value (the amount of misalignment) for the print heads H1 and H2 in the nozzle array direction.

First, the previously described adjustment pattern (a test pattern) is printed in order to detect a positional deviation (a vertical displacement) of the print heads H1 and H2 in the nozzle array direction (step S1). The results of printing the pattern are employed to detect the adjustment value (the amount of misalignment) of the print heads H1 and H2 in the nozzle array direction (step S2). The printing results for the adjustment pattern can be obtained by employing the optical sensor 203 described above while referring to FIG. 2. The adjustment value (the degree of misalignment) may be obtained by a user by performing a visual evaluation of the printing results of the adjustment pattern. The adjustment value is stored in a memory as an adjustment value for a position in the vertical direction (step S3). The adjustment values for the print heads H3 and H4 are also detected and stored by performing the same process.

Figure 11B:
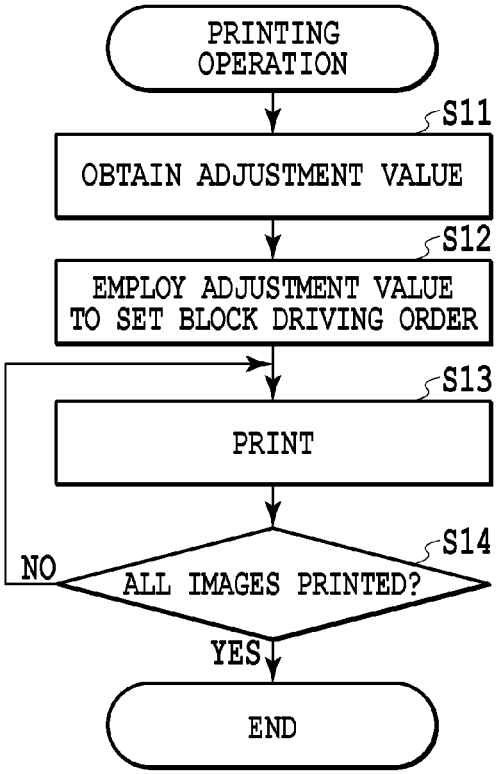

FIG. 11B is a flowchart for explaining the printing operation.

First, the adjustment value stored in the memory at step S3 is obtained (step S11). Thereafter, a block driving order corresponding to the block driving order for the reference print head H1 is shifted by a value equivalent to the adjustment value, and the obtained order is set as the block driving order for the print head H2 (step S12). That is, the block driving order for the print head H2 is set, so that for the print heads H1 and H2, the same blocks to which the nozzles belong are to be driven to form ink dots for a single raster. The block driving orders for the print heads H3 and H4 are also set in the same manner. Thereafter, the individual print heads are driven in the block driving orders that have been designated, and image printing is performed until all of the images have been printed (steps S13 and S14).

As described above, in this embodiment, the amount of misalignment among a plurality of print heads, in the nozzle array direction, is detected, and based on the detection results, the block driving orders for the print heads are designated. As a result, a change in a dot coverage rate (an area factor) of a print medium is eliminated, and the occurrence of a belt-shaped density unevenness in a printed image is avoided.

Second Embodiment

Figure 12:
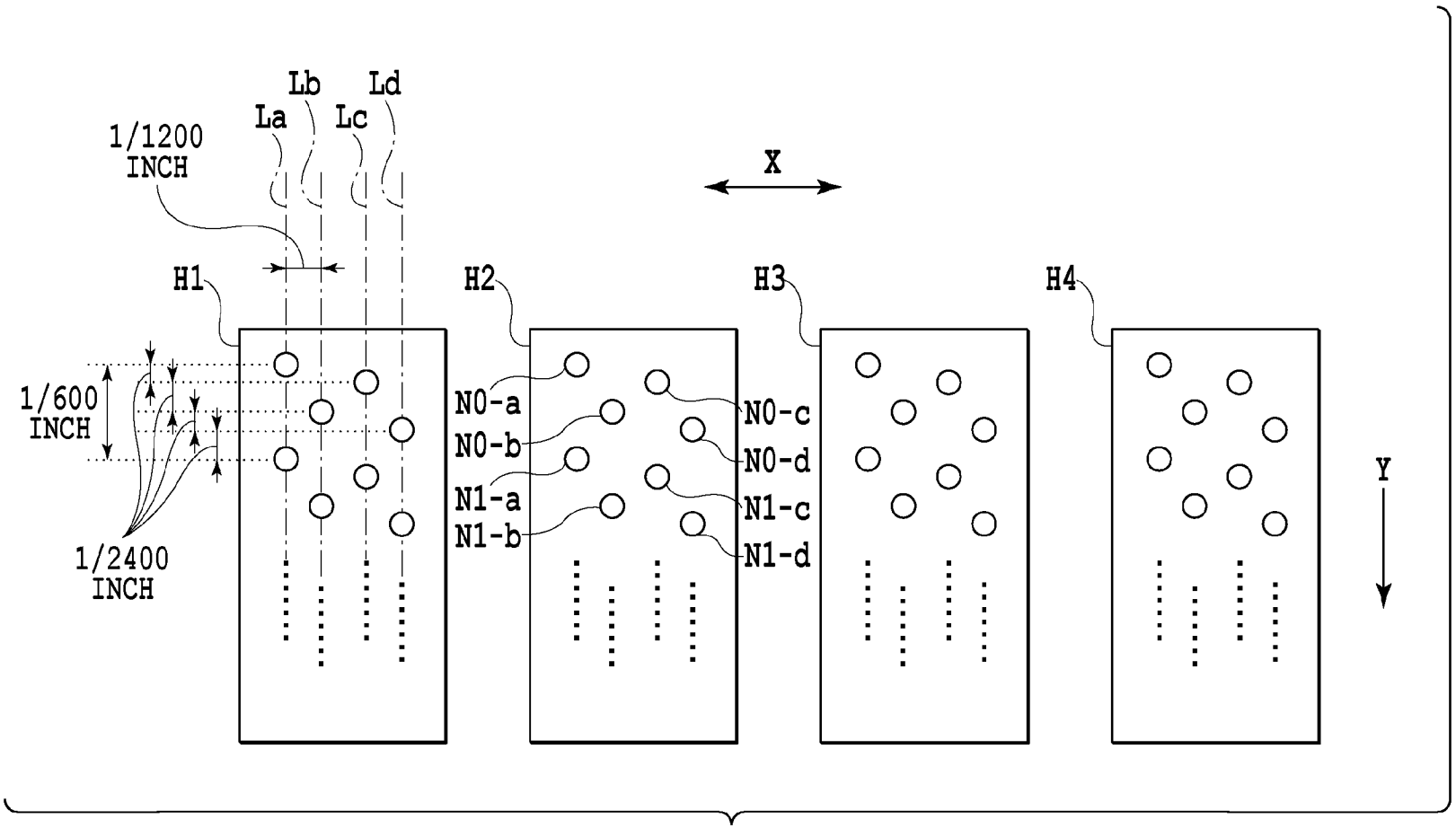
FIG. 12 is an explanatory diagram showing print heads that are mounted on a printing apparatus according to a second embodiment of the present invention.

FIG. 12 is an explanatory diagram for print heads according to a second embodiment of the present invention.

A print head H1 for black ink, a print head H2 for cyan ink, a print head H3 for magenta ink and a print head H3 for yellow ink are provided by employing independent chips. Four nozzle arrays La, Lb, Lc and Ld are formed on the individual chips using a semiconductor manufacturing method, and each of the nozzle arrays includes a plurality of nozzles at pitches of 600 dpi. The nozzle positions for the nozzle array La and the nozzle positions for the nozzle array Lb are shifted a distance of 1/1200 inch, and the nozzle positions of the nozzle array Lc and the nozzle positions of the nozzle array Ld are shifted a distance of 1/1200 inch. The nozzle positions of the nozzle array La and the nozzle positions of the nozzle array Lc are shifted a distance of 1/2400 inch, and the nozzle positions of the nozzle array Lb and the nozzle positions of the nozzle array Ld are shifted a distance of 1/2400 inch. With these nozzle arrays La, Lb, Lc and Ld, an image having a resolution of 2400 dpi can be printed in the nozzle array direction. In this embodiment, assume that numbers for the nozzles of the nozzle array La are N0-*a*, N1-*a*, N2-*a*, . . . from the top to the bottom in FIG. 12, and numbers for the nozzles of nozzle array Lb are N0-*b*, N1-*b*, N2-*b*, . . . from the top to the bottom in FIG. 12. Further, assume that numbers for the nozzles of the nozzle array Lc are N0-*c*, N1-*c*, N2-*c*, . . . from the top to the bottom, and numbers for the nozzles of the nozzle array Ld are N0-*d*, N1-*d*, N2-*d*, . . . from the top to the bottom.

Since the chips for the individual print heads are fabricated using by a semiconductor manufacturing method, it is assumed that the nozzles are aligned and positioned so as to form the nozzle arrays La, Lb, Lc and Ld on a single chip, and thus, a displacement in the landing positions of ink droplets ejected through these nozzles will not occur. However, since the print heads are detachably mounted on the carriage so that they are parallel to each other as shown in FIG. 12, the print heads, while being mounted on the carriage, might be misaligned relative to each other in the nozzle array direction. In this embodiment, as well as in the above described example, the block driving orders for the print heads H2, H3 and H4 are designated in accordance with positional deviations, in the nozzle array direction, of the print heads H2, H3 and H4 relative to the reference print head H1. That is, the amounts of misalignment of the print heads H2, H3 and H4 with the print head H1 are employed to set the block driving order for the nozzle arrays La, Lb, Lc and Ld of the print heads H2, H3 and H4.

Figure 13A:
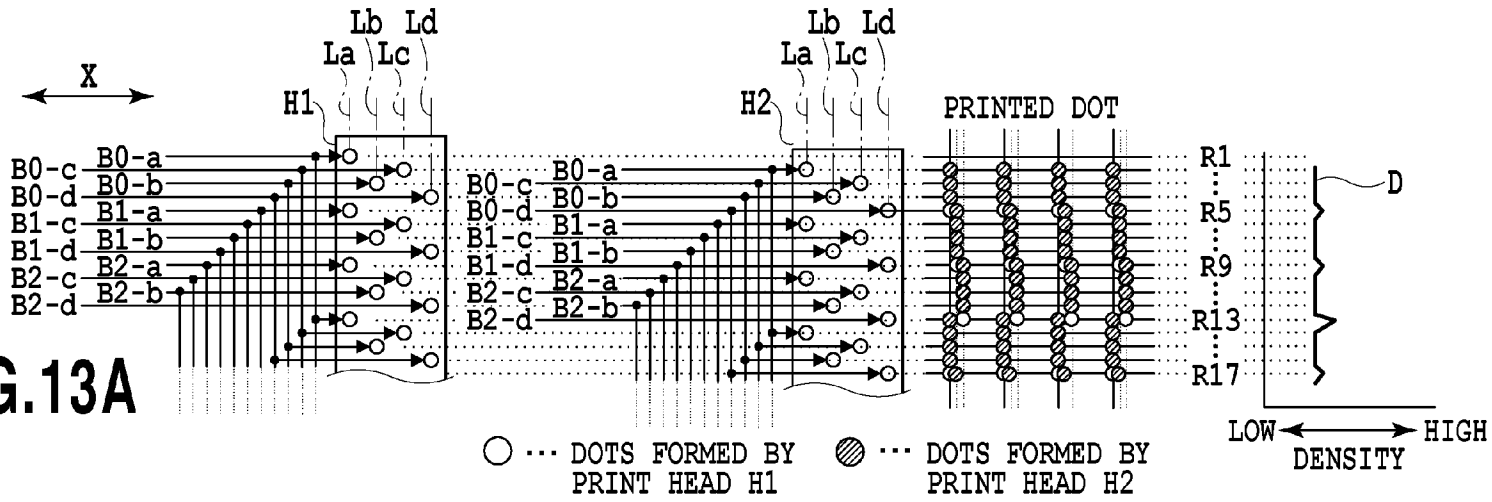
FIGS. 13A and 13B are explanatory diagrams showing the landing positions for ink, according to the second embodiment of the invention, before and after the order for driving blocks is changed.

FIG. 13A is a diagram for explaining the landing positions of ink that were ejected by driving the blocks of the print heads H1 and H2 in the same order, in a case wherein the print head H2 is shifted away from the print head H1 a distance equivalent to one nozzle in the nozzle array direction. In this example, the nozzles of the nozzle arrays La, Lb, Lc and Ld of the individual print heads H1 and H2 are divided into three blocks 0, 1 and 2. Furthermore, the nozzles of the nozzle array La are divided into blocks 0, 1 and 2, i.e., blocks B0-*a*, B1-*a* and B2-*a*. Then, nozzles N0-*a*, N3-*a*, N6-*a*, . . . are allocated to the block B0-*a*, nozzles N1-*a*, N4-*a*, N7-*a*, . . . are allocated to the block B1-*a*, and nozzles N2-*a*, N5-*a*, N8-*a*, . . . are allocated to the block B2-*a*. Likewise, the nozzles of the nozzle array Lb are divided into blocks 0, 1 and 2, i.e., blocks B0-*b*, B1-*b* and B2-*b*. That is, nozzles N0-*b*, N3-*b*, N6-*b*, . . . are allocated to the block B0-*b*, nozzles N1-*b*, N4-*b*, N7-*b*, . . . are allocated to the block B1-*b*, and nozzles N2-*b*, N5-*b*, N8-*b*, . . . are allocated to the block B2-*b*. Furthermore, the nozzles of the nozzle array Lc are divided into blocks 0, 1 and 2, i.e., blocks B0-*c*, B1-*c* and B2-*c*, and the nozzles of the nozzle array Ld are divided into the blocks 0, 1 and 2, i.e., blocks B0-*d*, B1-*d* and B2-*d*.

The nozzles allocated to the blocks 0, 1 and 2 are driven in the block order, 0, 1 and 2. Therefore, the displacement distance between the actual landing position of ink ejected from a nozzle and the ideal ink landing position becomes larger as the driving order of the nozzle increases (as the nozzle is driven later in time). In this embodiment, to simplify the explanation, it is assumed that the ideal positions are those at which ink droplets, ejected through the nozzles of the nozzle arrays La, Lb, Lc and Ld of the individual print heads, land in the main scan direction indicated by the arrow X.

Since the nozzle for the print head H2 is not present to cope with a raster R1, the nozzle N0-*a* (the first nozzle) of the print head H1 is not used during the scanning of the leading portion of an image. However, when print data are present during the following scanning process, the nozzle N0-*a* of the print head H1 is employed.

The print head H1 forms ink dots for rasters R2 to R4 by employing the nozzles that belong to the block 0, forms ink dots for rasters R5 to R8 by employing the nozzles that belong to the block 1, and forms ink dots for rasters R9 to R12 by employing the nozzles that belong to the block 2. The print head H2 forms ink dots for rasters R2 to R5 by employing the nozzles that belong to the block 0, forms ink dots for the rasters R6 to R9 by employing the nozzles that belong to the block 1, and forms ink dots for the rasters R10 to R13 by employing the nozzles that belong to the block 2. Therefore, the print heads H1 and H2 each drive different blocks of nozzles to form ink dots for the rasters R5, R9, R13 and R17.

When different blocks of nozzles are driven by the print heads to form ink dots for the same raster, the landing positions of ink ejected by the print heads are displaced, and the dot coverage rate (an area factor) for the print medium is changed due to this displacement. As a result, the density distribution D of the printed image becomes non-uniform in the nozzle array direction. And since the non-uniformity of the density distribution D is present in the nozzle array direction, a belt-shaped density unevenness may occur in a printed image.

Figure 13B:
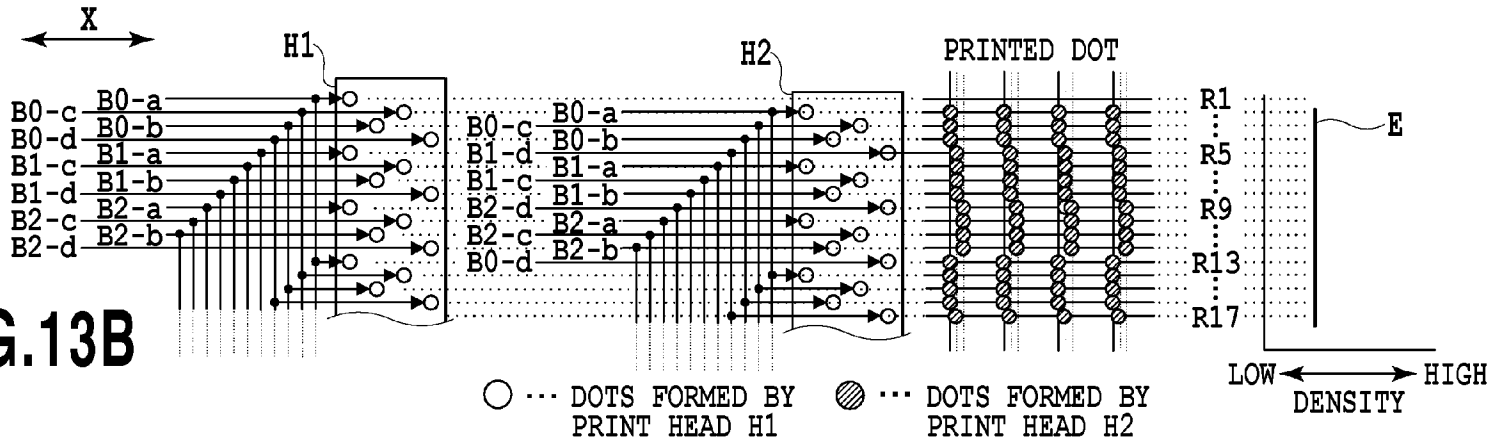

In this embodiment, as shown in FIG. 13B, the block driving orders are changed in accordance with the amount of misalignment between the print heads H1 and H2 in the nozzle array direction. Specifically, based on the previously described adjustment pattern (a test pattern) that is printed, the amount of misalignment between the print heads H1 and H2 in the nozzle array direction is detected, and is employed to change the block driving orders.

Referring to FIG. 13B, the print head H2, as well as the print head H1, employs the nozzles allocated to the blocks to form ink dots for the same rasters as the print head H1 targets. That is, the print head H2 forms ink dots for the rasters R2 to R4 by employing the nozzles that belong to the block 0, forms ink dots for the rasters R5 to R8 by employing the nozzles that belong to the block 1, and forms ink dots for the rasters R9 to R12 by employing the nozzles that belong to the block 2. Therefore, the same blocks of nozzles are to be driven by the print heads H1 and H2 to form ink dots for the same raster. As a result, the landing positions of the ink ejected through the print heads H1 and H2 are identical, and the dot coverage rate (the area factor) of the print medium is constant, and the density distribution E for the print image becomes uniform in the nozzle array direction. Since the uniform density distribution E is obtained, the occurrence of the belt-shaped density unevenness, as shown in FIG. 13A, can be avoided.

In this embodiment, the block driving order is changed in accordance with the amount of misalignment between the print heads H1 and H2 in the nozzle array direction. The block driving orders for the print heads H3 and H4 can also be changed by employing the print head H1 as a reference. Further, the process for setting the adjustment value (the amount of misalignment) in the nozzle array direction, for the individual print heads and the printing operation, is performed in the same manner as in the above embodiment.

Third Embodiment

Figure 14:
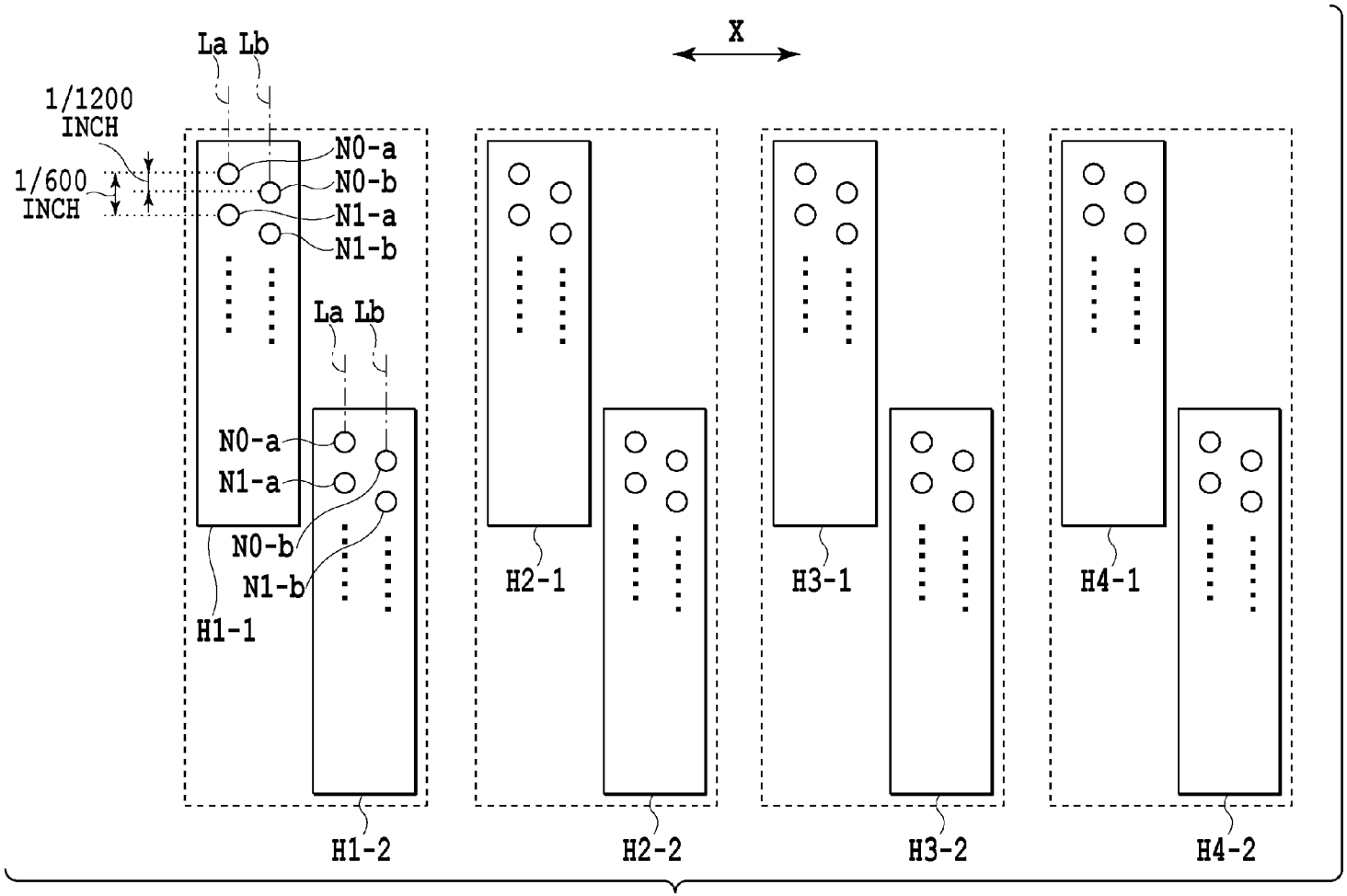
FIG. 14 is an explanatory diagram illustrating print heads mounted on a printing apparatus according to a third embodiment of the present invention.

FIG. 14 is an explanatory diagram for print heads according to a third embodiment of the present invention.

As shown in FIG. 14, two print heads H1-1 and H1-2 for black ink ejection are arranged so that they partially overlap, and two print heads H2-1 and H2-2 for cyan ink ejection are arranged so that they partially overlap. Similarly, two print heads H3-1 and H3-2 for magenta ink ejection are arranged so that they partially overlap, and two print heads H4-1 and H4-2 for yellow ink ejection are arranged so that they partially overlap. These four pairs of print heads, i.e., a total of eight print heads, are provided on independent chips. The individual print heads include two nozzle arrays La and Lb, each of which consists of a plurality of nozzles arranged at intervals of 1/600 inch, and the nozzles of the nozzle array La and the nozzles of the nozzle array Lb are shifted away from each other a distance of 1/1200 inch. The number of nozzles used to form either the nozzle array La or the nozzle array Lb is defined as N. Further, the nozzles of the nozzle array La are denoted by N0-*a*, N1-*a*, . . . N(N−2)-a, N(N−1)-a and N(N)-a from the top to the bottom in FIG. 14. And the nozzles of the nozzle array Lb are denoted by N0-*b*, N1-*b*, . . . , N(N−2)-b, N(N−1)-b and N(N)-b from the top to the bottom in FIG. 14.

Since the chips for the individual print heads are fabricated using a semiconductor manufacturing method, it is assumed that the nozzles are aligned and positioned to form the nozzle arrays La and Lb on a single chip, and no displacement will occur in the landing positions of ink ejected through these nozzles. However, since the print heads are detachably mounted on the carriage so that they are parallel to each other, as shown in FIG. 14, there is a case wherein the print heads mounted on the carriage are misaligned in the nozzle array direction. In this embodiment, the block driving orders for the print heads are designated in accordance with a misalignment amongst the print heads in the nozzle array direction.

Figure 15A:
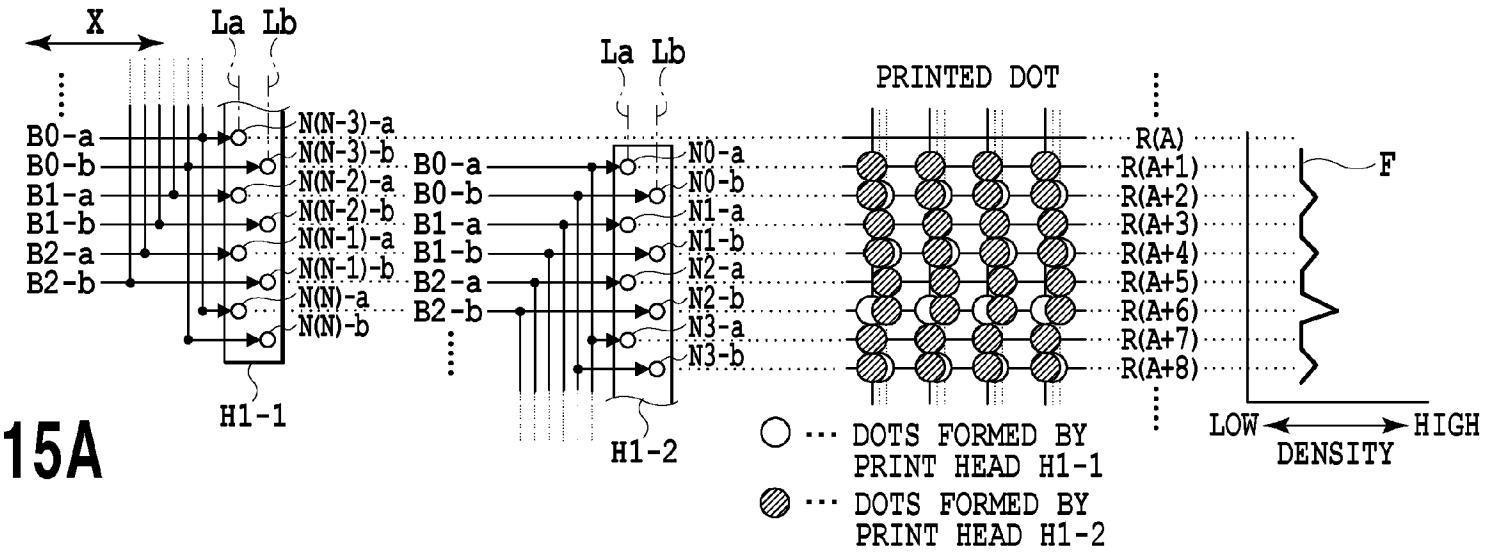
FIGS. 15A and 15B are explanatory diagrams showing the landing positions for ink, according to the third embodiment of the invention, before and after the order for driving blocks is changed.

FIG. 15A is a diagram for explaining the landing positions of ink ejected by driving the blocks of the print heads H1-1 and H1-2 in the same order, in a case wherein the print head H1-2 is shifted away from the print head H1-1 a distance equivalent to one nozzle in the nozzle array direction. In this embodiment, the nozzles of the nozzle arrays La and Lb of the print heads H1-1 and H1-2 are divided into three blocks, 0, 1 and 2. Specifically, for the individual print heads H1-1 and H1-2, the nozzles of the nozzle array La are divided into the nozzle array La blocks 0, 1 and 2 (blocks B0-*a*, B1-*a* and B2-*a*). That is, the nozzles N0-*a*, . . . , N(N−3)-a and N(N)-a are allocated to the block B0-*a*, the nozzles N1-*a*, . . . and N(N−2)-a are allocated to the block B1-*a*, and the nozzles N2-*a*, . . . and N(N−1)-a are allocated to the block B2-*a*. Similarly, the nozzles of the nozzle array Lb for the individual print heads are divided into the nozzle array Lb blocks 0, 1 and 2 (blocks B0-*b*, B1-*b* and B2-*b*). That is, the nozzles N0-*b*, . . . , N(N−3)-b and N(N)-b are allocated to the block B0-*b*, the nozzles N1-*b*, . . . and N(N−2)-b are allocated to the block B1-*b*, and the nozzles N2-*b*, . . . and N(N−1)-b are allocated to the block B2-*b*.

The nozzles allocated to the blocks 0, 1 and 2 are driven in the block order 0, 1 and 2. Therefore, the displacement distance between the actual landing position of ink ejected from a nozzle and the ideal ink landing position becomes larger as the driving order of the nozzle increases (as the nozzle is driven later in time).

The print head H1-1 forms ink dots for a raster R(A+1) by employing the nozzles that belong to the block 0 (B0-*b*), and forms ink dots for rasters R(A+2) and R(A+3) by employing the nozzles that belong to the block 1 (B1-*a* and B1-*b*). Further, the print head H1-1 forms ink dots on rasters R(A+4) and R(A+5) by employing the nozzles that belong to the block 2 (B2-*a* and B2-*b*). On the other hand, the print head H1-2 forms ink dots for the rasters R(A+1) and R(A+2) by employing the nozzles that belong to the block 0 (B0-*a* and B0-*b*), and forms ink dots for the rasters R(A+3) and R(A+4) by employing the nozzles that belong to the block 1 (B1-*a* and B1-*b*). The print head H1-2 also forms ink dots for the rasters R(A+5) and R(A+6) by employing the nozzles that belong to the block 2 (B2-*a* and B2-*b*). Therefore, for the print heads H1-1 and H1-2, different blocks of nozzles are driven to form ink dots for the rasters R(A+2), R(A+4), R(A+6) and R(A+8).

As described above, when the different blocks of nozzles are driven by the print heads to form ink dots for a single raster, landing positions for ink ejected by the print heads are displaced, and the dot coverage rate (an area factor) for a print medium is changed due to the displacement. As a result, a density distribution F for a printed image becomes non-uniform in the nozzle array direction. Since the non-uniformity of the density distribution F is present in the nozzle array direction, the belt-shaped density unevenness may occur in a printed image.

Figure 15B:
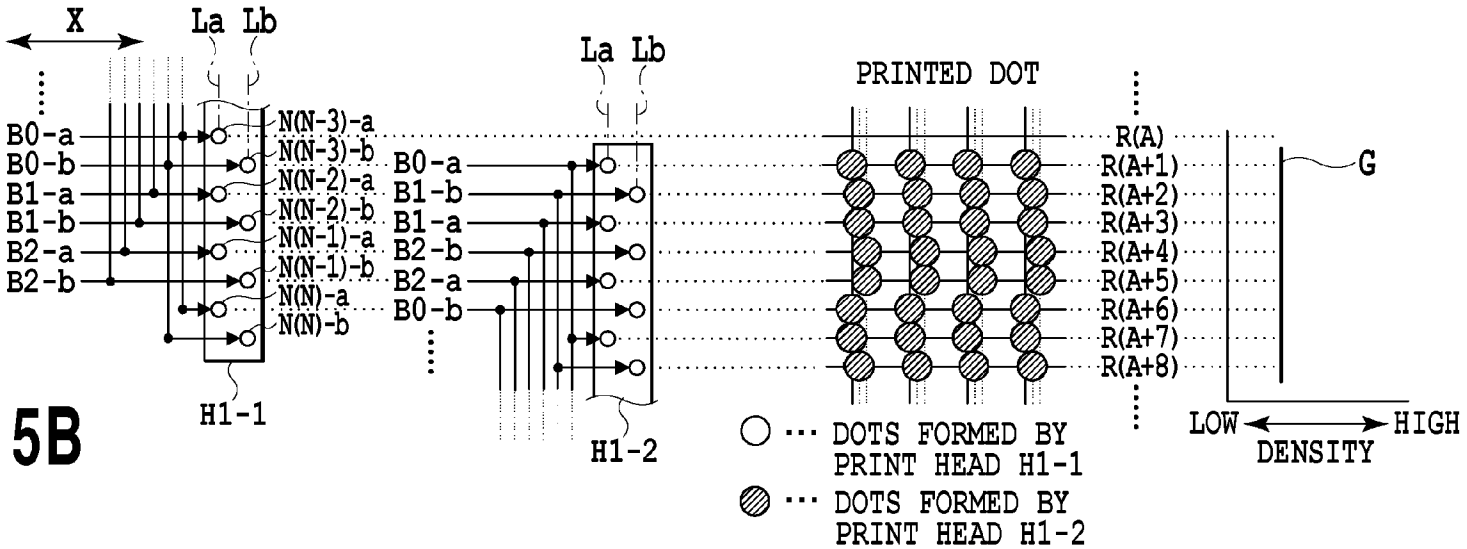

In this embodiment, as shown in FIG. 15B, the block driving order is changed in accordance with the amount of misalignment between the print heads H1-1 and H1-2 in the nozzle array direction. That is, based on the previously described adjustment pattern (a test pattern) that is printed, the amount of misalignment between the print heads H1-1 and H1-2 is detected and employed to change the block driving order.

Referring to FIG. 15B, the print head H1-2, as well as the print head H1-1, employs the nozzles allocated to blocks to form ink dots for the same rasters as those which are the print head H1-1 targets. Specifically, the print head H1-2 forms ink dots for the raster R(A+1) by employing the nozzles that belong to the block 0 (B0-*a*), and forms ink dots for the rasters R(A+2) and R(A+3) by employing the nozzles that belong to the block 1 (B1-*b* and B1-*a*). Further, the print head H1-2 forms ink dots for the rasters R(A+4) and R(A+5) by employing the nozzles that belong to the block 2 (B2-*b* and B2-*a*). Therefore, for the print heads H1-1 and H1-2, the same blocks of nozzles are employed to form ink dots for the same rasters. And as a result, the landing positions for ink ejected through the joint portions (the overlapping portions) of the individual print heads match, the dot coverage rate (the area factor) for a print medium is constant, and the density distribution for a printed image becomes uniform in the nozzle array direction. Thus, since the uniform density distribution G is obtained, the occurrence of the belt-shaped density unevenness, as shown in FIG. 15A, can be avoided.

In this embodiment, the block driving order is changed in accordance with the amount of misalignment between the print heads H1-1 and H1-2 in the nozzle array direction. The block driving order for the other print heads can also be changed in the same manner.

Figure 16A:
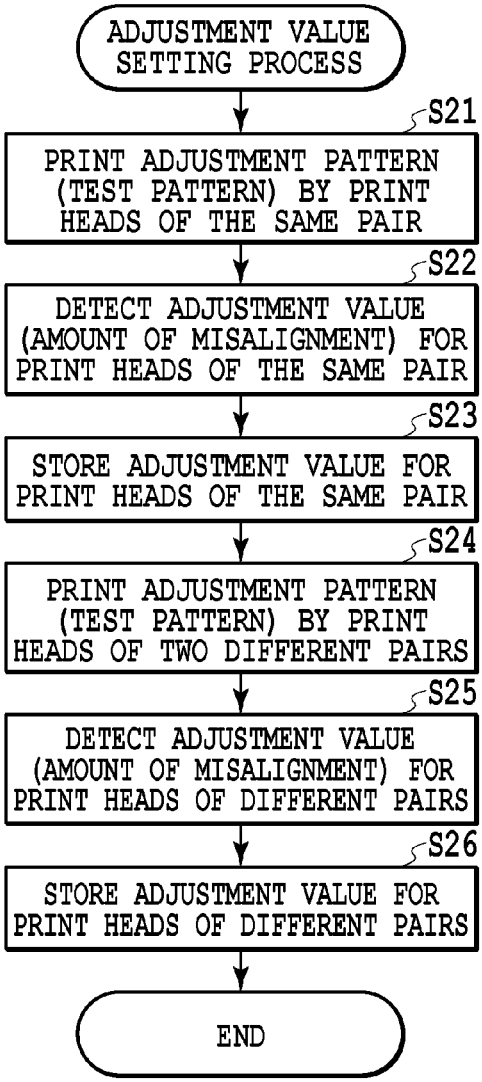
FIGS. 16A and 16B are flowcharts for explaining the processing for setting an adjustment value and the printing operation according to the third embodiment of the present invention.

FIG. 16A is a flowchart for explaining the processing for setting adjustment values (amounts of deviation) in the nozzle array direction for the above described four pairs of print heads in FIG. 14, i.e., a total of eight print heads.

First, an adjustment pattern (a test pattern) described above is printed in order to detect a deviation (a vertical displacement) between the print heads in one pair in the nozzle array direction (step S21). That is, an adjustment pattern is printed by employing the overlapping portions of the print heads H1-1 and H1-2 as a pair, while an adjustment pattern is printed by employing the overlapped portion of the print heads H2-1 and H2-2 as a pair. Similarly, an adjustment pattern is printed by employing the overlapping portions of the print heads H3-1 and H3-2 as a pair, and an adjustment pattern is printed by employing the overlapping portions of the print heads H4-1 and H4-2 as a pair. Then, in the same manner as described above, each adjustment pattern printed is employed to detect an adjustment value in the nozzle array direction (the amount of misalignment) for the print heads as a pair that corresponds to the adjustment pattern (step S22). The printing results for the adjustment pattern can be detected using the optical sensor 203, previously described while referring to FIG. 2. The adjustment value (the amount of misalignment) may be detected by a user through a visual evaluation of the printing results of the adjustment pattern. The obtained adjustment value is then stored, in the memory, as the vertical positional adjustment value for the print heads of the pertinent pair (registration adjustment value for the vertical direction) (step S23).

Following this, an adjustment pattern (a test pattern), as described above, is printed to detect the displacement (the vertical deviation) in the nozzle array direction between the print heads that belong to different pairs (step S24). That is, an adjustment pattern is printed by the print heads H1-1 and H2-1 that belong to different pairs, an adjustment pattern is printed by the print heads H1-1 and H3-1 of different pairs, and an adjustment pattern is printed by the print heads H1-1 and H4-1 of different pairs. As well as in the above described case, based on each adjustment pattern that is printed, an adjustment value (the amount of misalignment) in the nozzle array direction is detected for the print heads of the different pairs that correspond to the adjustment pattern (step S25). In this embodiment, the print head H1-1 is employed as a reference to detect the adjustment values (the amounts of misalignment) for the print heads H2-1, H3-1 and H4-1. The obtained adjustment values are stored in the memory as the vertical positional adjustment values (the registration adjustment values obtained for vertical readings) for the print heads that belong to different pairs (step S26).

When these adjustment values are employed, the deviation of the print head H1-2 from the print head H1-1 in the nozzle array direction and the deviation of the print head H2-2 from the print head H2-1 in the nozzle array direction can be adjusted. Likewise, the deviation of the print head H3-2 from the print head H3-1 in the nozzle array direction, and the deviation of the print head H4-2 from the print head H4-1 in the nozzle array direction can also be adjusted. Further, the deviations of the print heads H2-1, H3-1 and H4-1 from the reference print head H-1 in the nozzle array direction can be adjusted. As a result, with the print head H1-1 being employed as a reference, the deviations of all the other print heads in the nozzle array direction can be adjusted.

Figure 16B:
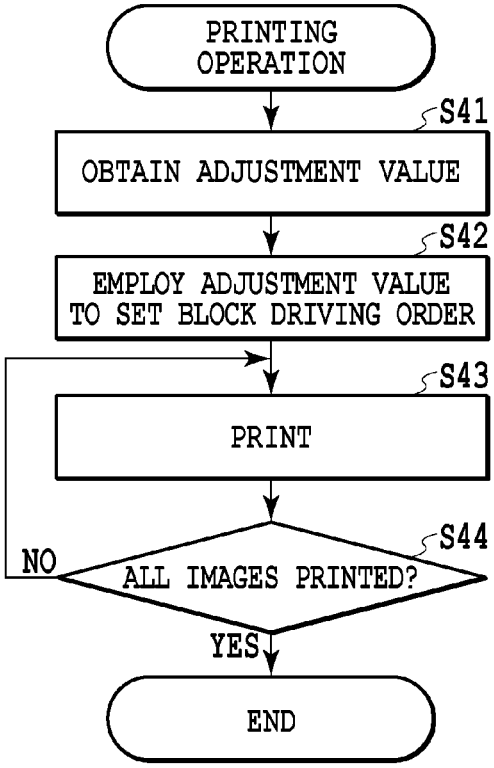

FIG. 16B is a flowchart for explaining the printing operation.

First, the adjustment values stored in the memory at steps S23 and S26 are obtained (step S41). Then, a block driving order corresponding to the block driving order for the reference print head H1-1 is shifted a distance equivalent to the adjustment value, and the obtained block order is designated the block driving order for the print heads H1-2, H2-1, H2-2, H3-1, H3-2, H4-1 and H4-2 (step S42). That is, the block driving orders are set so that the individual print heads drive the same blocks of nozzles to form ink dots for the same raster. Specifically, for the nozzle arrays La and Lb of the print head H1-2, the block driving order is set by employing the print head H1-1 as a reference, and for the nozzle arrays La and Lb of the print head H2-1, the block driving order is set based on an adjustment value that is obtained by employing the print head H1-1 as a reference. While for the nozzle arrays La and Lb of the print head H2-2, the block driving order is set by taking into account the adjustment value for the print head H2-1, which is obtained using the print head H1-1 as a reference, and the adjustment value for the print head H2-2, which is obtained using the print head H2-1 as a reference. The block driving orders for the print heads H3-1, H3-2, H4-1 and H4-2 are also set in the same manner.

Thereafter, the individual print heads are driven in accordance with the block driving orders that are designated, and printing is performed until all the images have been printed (steps S43 and S44).

As described above, according to this embodiment, with the arrangement wherein a plurality of pairs of print heads are employed, the amount of deviation between the print heads in the nozzle array direction is detected, and the block driving order for the individual print heads is designated based on the detected deviation. As a result, a fluctuation in the dot coverage rate (an area factor) for a print medium is eliminated, and the occurrence of the belt-shaped density unevenness in a printed image and the granular degradation of the image can be suppressed.

Fourth Embodiment

According to a fourth embodiment of the present invention, image printing is performed by employing both a multi-pass printing method, for moving a print head a plurality of times (a plurality of passes (scans)) and printing a predetermined area of a print medium, and a method for performing time-division driving for a plurality of nozzles (a block driving method). According to the multi-pass printing method (n pass printing method), an image is sequentially printed by alternately employing a print head to perform printing in the main scan direction and conveying a print medium in the sub-scan direction a distance equivalent to 1/n the printing width, which corresponds to the length of the nozzle array of the print head. Ink dots are formed for a single raster using a plurality of different nozzles. For example, when a two-pass printing method is performed, the distance in which a print medium is conveyed in the sub-scan direction is ½ the length of the nozzle array, and the ink dots are printed for a single raster using two different nozzles. Whereas, when the time-division driving method is performed, a plurality of nozzles forming the nozzle array is divided into a plurality of blocks to be driven as described above. And when a time-division number is three, the nozzles are divided into three blocks, before being driven.

When the distance in which a print medium is to be conveyed is not divisible by a time division number (e.g., when a two-pass printing method and a block driving method employing a time-division number of three are employed together), combination nozzles employed to form ink dots for a single raster are changed. Therefore, blocks to which these nozzles belong may differ. In this embodiment, while taking such a case into account, the block driving order is designated for each pass of the print head, so that the nozzles employed to form ink dots for a single raster belong to the same block. Therefore, as well as in the embodiments described above, adjustment values stored in the memory are employed to designate the block driving order. And at this time, a distance a print medium is intermittently conveyed is also considered.

Figure 17A:
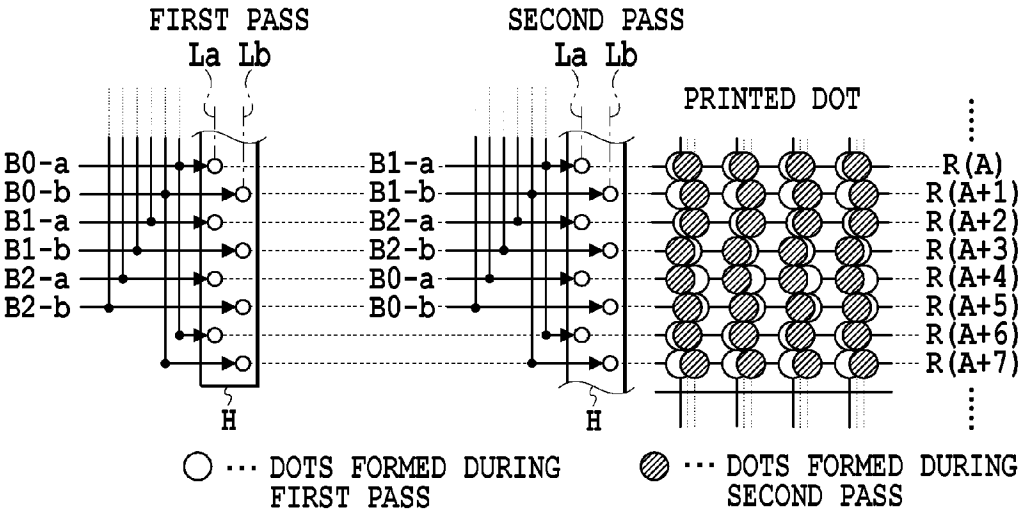
FIGS. 17A and 17B are explanatory diagrams showing the landing positions for ink according to a fourth embodiment of the present invention, before and after the order for driving blocks is changed.

FIG. 17A is a diagram for explaining the landing positions for ink ejected when the block driving order is not changed between the first pass and the second pass for the arrangement that employs both the two-pass printing method and the block driving method employing a time-division number of three. In this example, the nozzles of nozzle arrays La and Lb of a print head H are divided into three blocks 0, 1 and 2. That is, the nozzles of the nozzle array La are divided into the nozzle array La blocks 0, 1 and 2 (B0-*a*, B1-*a* and B2-*a*), and the nozzles of the nozzle array Lb are divided into the nozzle array Lb blocks 0, 1 and 2 (B0-*b*, B1-*b* and B2-*b*).

The nozzles allocated to these blocks 0, 1 and 2 are driven in the block order 0, 1 and 2. Therefore, the displacement distance between the actual landing position of ink ejected from a nozzle and the ideal ink landing position becomes larger as the driving order of the nozzle increases (as the nozzle is driven later in time).

During a first pass, the print head H forms ink dots for rasters R(A) and R(A+1) by employing the nozzles that belong to the block 0 (B0-*a* and B0-*b*), and prints ink dots for rasters R(A+2) and R(A+3) by employing the nozzles that belong to the block 1 (B1-*a* and B1-*b*). Further, the print head H forms ink dots for rasters R(A+4) and R(A+5) by employing the block 2 (B2-*a* and B2-*b*). During a second pass, the print head H forms ink dots for the rasters R(A) and R(A+1) by employing the nozzles that belong to the block 1 (B1-*a* and B1-*b*), and forms ink dots for the rasters R(A+2) and R(A+3) by employing the nozzles that belong to the block 2 (B2-*a* and B2-*b*). The print head H also forms ink dots for the rasters R(A+4) and R(A+5) by employing the nozzles that belong to the block 0 (B0-*a* and B0-*b*).

Therefore, different blocks of nozzles are driven between the first pass and the second pass of the print head H to form ink dots for the same raster. As a result, the landing positions of ink ejected from the print head H are displaced between the first pass and the second pass, the dot coverage rate (an area factor) of a print medium is changed due to this displacement, and the density distribution of the printed image becomes non-uniform in the nozzle array direction. Since the non-uniformity of the density distribution is present in the nozzle array direction, a belt-shaped density unevenness may appear in the printed image.

According to this embodiment, the block driving order for the print head H is set for the first pass and the second pass, so that multiple nozzles used to form ink dots for the same raster can belong to the same block.

Figure 17B:
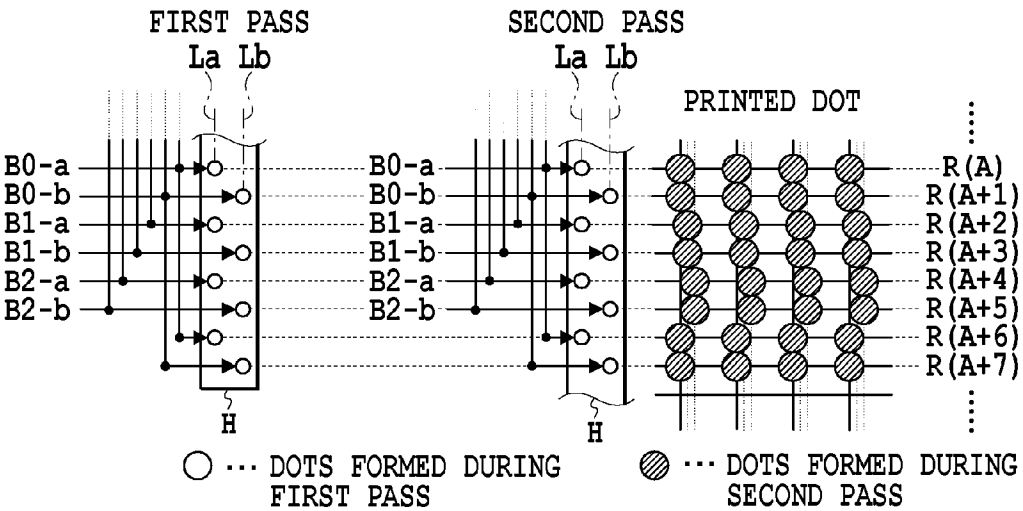

Specifically, as shown in FIG. 17B, during the first pass, the nozzles that belong to the block 0 (B0-*a* and B0-*b*) are employed to form ink dots for the rasters R(A) and R(A+1). Further, the nozzles that belong to the block 1 (B1-*a* and B1-*b*) are employed to form ink dots for the rasters R(A+2) and R(A+3), and the nozzles that belong to the block 2 (B2-*a* and B2-*b*) are employed to form ink dots for the rasters R(A+4) and R(A+5). During the second pass, the nozzles that belong to the block 0 (B0-*a* and B0-*b*) are employed to form ink dots for the rasters R(A) and (A+1), and the nozzles that belong to the block 1 (B1-*a* and B1-*b*) are employed to form ink dots for the rasters R(A+2) and R(A+3). Furthermore, the nozzles that belong to the block 2 (B2-*a* and B2-*b*) are employed to form ink dots for the rasters R(A+4) and R(A+5).

Therefore, the same blocks of nozzles are driven to form ink dots for the same raster. As a result, the landing positions for the ink ejected through these nozzles are matched, the dot coverage rate (an area factor) of a print medium are constant, and the density distribution for a printed image becomes uniform in the nozzle array direction. Since the uniform density distribution is obtained, the occurrence of the belt-shaped density unevenness can be avoided.

FIG. 18 is an explanatory diagram for a table employed to set block driving orders for the nozzle arrays La and Lb of the print head H, for the individual passes. In a case wherein, as shown in FIG. 17A, the block driving order is unchanged, a set of blocks of the nozzles employed for forming ink dots for the same raster is changed in accordance with a distance that a print medium is intermittently conveyed. Therefore, as shown in FIG. 18, for each pass, block driving orders for the nozzle array La are set as A-1, A-2, . . . and block driving orders for the nozzle array Lb are set as B-1, B-2, . . . , so that ink dots for the same raster can be formed by using the nozzles of the same block.

Figure 19:
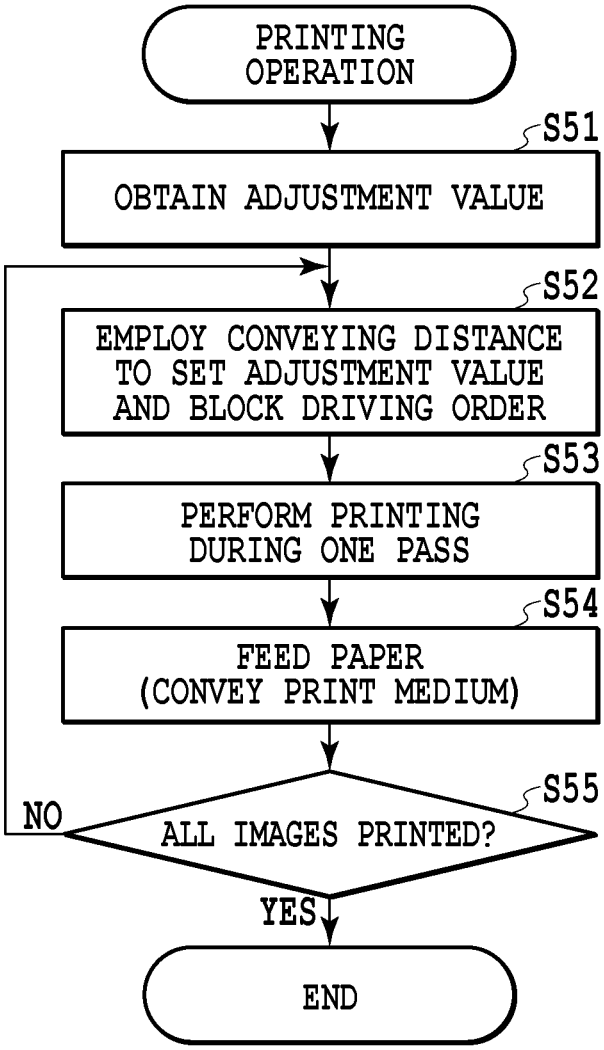
FIG. 19 is a flowchart for explaining the printing operation performed in the fourth embodiment of the present invention.

FIG. 19 is a flowchart for explaining the printing operation.

First, adjustment values stored in the memory are obtained (step S51). Then, the block driving order for the print head is designated, based on the adjustment values and the distance of the print medium to be conveyed (step S52). Thereafter, the nozzles are driven in accordance with the designated block driving order and the print head is moved in the main scan direction, so that an image equivalent to one pass of the print head is printed (step S53). Following this, the print medium is conveyed a predetermined distance (step S54), and the printing processing at steps S52 to S54 is repeated until the whole image has been printed (step S55). Since the nozzle block driving order is designated for each pass in the above described manner, the nozzles in the same block are employed to form ink dots for the same raster.

According to this embodiment, the block driving order is changed for each pass of the single print head H. Even when a plurality of print heads are employed, the block driving orders of these print heads can be changed in the same manner.

As described above, in this embodiment, the block driving order of the print head is designated by taking into account a case wherein the distance in which a print medium is conveyed is not divisible by a time division number, and therefore, a set of nozzles used for forming ink dots for the same raster is changed. Since the block driving order is set for each pass, the nozzles of the same block can be employed to form ink dots for the same raster. As a result, fluctuation in the dot convergence rate (an area factor) of the print medium is eliminated, and the occurrence, on a printed image, of the belt-shaped density unevenness can be avoided.

Other Embodiment

In the above described embodiments, the nozzles are driven by blocks (sequential driving), so that the order in which the nozzles are arranged on the print head matches the order of the blocks for which the nozzles are allocated. The present invention is not limited to such a sequential driving, and can also be applied for a case wherein nozzles are driven by blocks (distributed driving) so as not to match the order in which the nozzles are arranged in the print head and the order in which the blocks, for which the nozzles are allocated, are arranged.

First, sequential driving as performed in the above embodiments will now be described while referring to FIG. 20A. In this embodiment, print heads H1 and H2 are driven after being divided into four nozzle blocks 1, 2, 3 and 4, and the block driving order for the print head H2 is changed according to the amount of a misalignment equivalent to a single nozzle between the print heads.

Figure 20A:
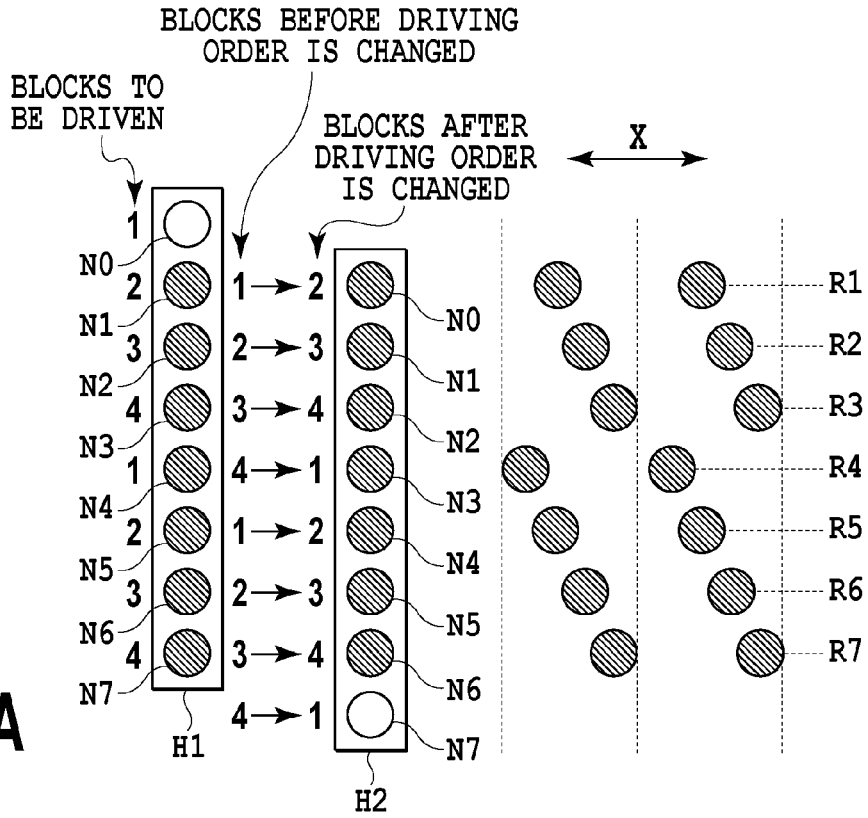
FIGS. 20A and 20B are explanatory diagrams showing sequential block driving and distributed block driving for which the present invention can be applied.

Referring to FIG. 20A, nozzles N0, N1, N2, N3, N4, N5, . . . for the print head H1 and the print head H2 are regarded as blocks 1, 2, 3, 4, 1, 2, . . . , before their block driving orders were changed. For the print head H2 for which the block driving order has been changed, the nozzles N0, N1, N2, N3, N4, N5, . . . are blocks 2, 3, 4, 1, 2, 3, 4, . . . , i.e., block numbers are provided in the order of 2, 3, 4 and 1 for the nozzles beginning with the nozzle N0. As described above, a correlation between the nozzles and the blocks is changed for the print head H2, and the change in the correlation is also called the "change in the block driving order". Both before and after the block driving order for the print head H2 has been changed, the nozzles of the print head H2 are driven in the block order 1, 2, 3 and 4. However, for the print head H2, before the block driving order was changed, the nozzles beginning with N0 are allocated to blocks 1, 2, 3 and 4 in the named order, while after the block driving order has been changed, the nozzles beginning with N0 were allocated to blocks 2, 3, 4 and 1 in the named order. Therefore, the correlation of the nozzles and the blocks to be driven is changed. In the case shown in FIG. 20A, since the nozzle blocks, to which the nozzles of the print heads H1 and H2 for forming ink dots for the same raster belong, are matched, ink dots can be formed at the same locations for the same raster.

Figure 20B:
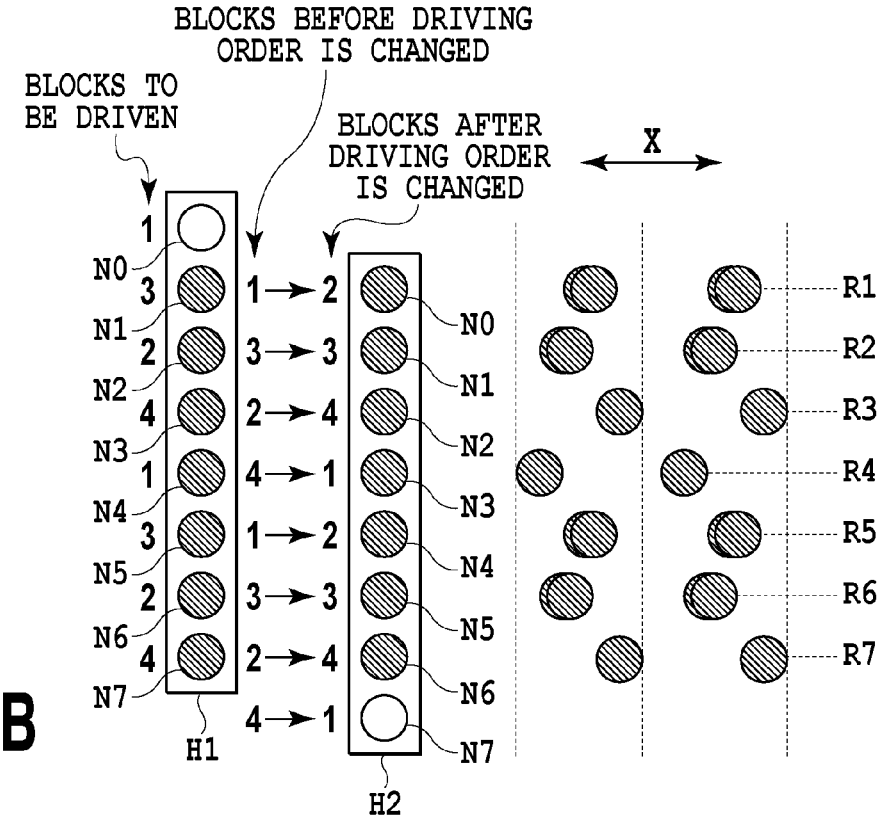

FIG. 20B is a diagram for explaining an example of a distributed driving for which the present invention can be applied. In this example, as well as in the case shown in FIG. 20A, print heads H1 and H2 are driven by being divided into four nozzle blocks 1, 2, 3 and 4, and the amount of misalignment of the print heads equivalent to one nozzle is employed to change the block driving order for the print head H2.

In FIG. 20B, for the print head H1 and the print head H2 before the block driving order was changed, nozzles N0, N1, N2, N3, N4, N5, . . . are assigned as blocks 1, 3, 2, 4, 1, 3, . . . But after the block driving order of the print head H2 has been changed, its nozzles N0, N1, N2, N3, N4, N5, . . . are reallocated as blocks 2, 3, 4, 1, 2, 3, 4, . . . , i.e., the block numbers are provided in the order of 2, 3, 4, 1, . . . for the nozzles beginning with N0. Since a correlation between the nozzles and the blocks has been changed for the print head H2, the change in such a correlation is also called the "change in the block driving order". According to the example shown in FIG. 20B, although the nozzles of the print head H1 and the nozzles of the print head H2, which are employed to form ink dots for the raster R1, are allocated to two different blocks 3 and 2, a difference between the drive times for these two blocks is small. Therefore, the displacement of ink dots formed for the raster R1 is very small. Likewise, the displacement of the ink dots formed for the raster R2 is also very small.

Further, when the amount of misalignment between the print heads H1 and H2 in the nozzle array direction is a predetermined distance, such as a distance equivalent to 0.5 nozzle, which is smaller than a distance equivalent to a single nozzle, the block driving order for the print head H2 is not changed. Furthermore, in a case wherein the amount of the misalignment between the print heads H1 and H2 is a predetermined distance, such as a distance equivalent to 1.3 nozzles, which is equal to or greater than a distance equivalent to a single nozzle and equal to or smaller than a distance equivalent to two nozzles, the block driving order for the print head H2 can be changed in the same manner as in the case when there is a deviation equivalent to that for a single nozzle.

The print heads of this embodiment are ink jet print heads in which a plurality of nozzles are arranged as printing elements, in the nozzle array direction (the printing element array direction). However, other types of print heads, such as thermal heads, may also be employed wherein various types of printing elements are arranged to form printing element arrays. In this case, time-division driving for a plurality of printing elements can be performed for each printing element array.

Further, the present invention can be applied not only for a serial scan printing apparatus that moves a print head in the main scan direction, but also for a printing apparatus for full-line printing in which a print medium is continuously conveyed and an elongated print head in the widthwise direction of the print medium is employed. In this case, the print head and the print medium are moved relative to each other, along a direction that intersects the nozzle arrays of the print head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-185196, filed Aug. 20, 2010, which is hereby incorporated by reference herein in its entirety.

What is claimed is:

1. A printing apparatus for printing an image on a print medium, comprising:

a print head comprising:

a first printing element array that includes first printing elements, and a second printing element array that includes second printing elements, wherein the first printing elements and the second printing elements are arranged in a predetermined direction, and the first printing element array and the second printing element array are arranged in a direction crossing the predetermined direction, and wherein the first and second printing elements are configured to be driven in respective driving orders during relative movement between the print head and the print medium in the direction crossing the predetermined direction;

an obtaining unit configured to obtain information relating to a displacement of the first printing element array relative to the second printing element array in the predetermined direction; and a determining unit configured to determine the respective driving orders based on the displacement represented by the information obtained by the obtaining unit.

2. The printing apparatus according to claim 1, wherein the first printing elements of the first printing element array and the second printing elements of the second printing element array print on a same raster area of the print medium.

3. The printing apparatus according to claim 2, wherein the first and second printing elements of the first and second printing element arrays are divided into a plurality of driving blocks and driven by a time division method such that printing elements belonging to different driving blocks are sequentially driven by a unit of the driving block, and wherein the determining unit determines the respective driving orders for the first and second printing elements, so that a difference in drive timing between the driving blocks, to which printing elements of the first and second printing element arrays employed to print on the same raster respectively belong, is reduced.

4. The printing apparatus according to claim 1, wherein the determining unit determines the respective driving orders for the first and second printing elements, such that a difference in drive timing between printing elements of the first and second printing elements which are employed to print on a same raster area of the print medium is reduced.

5. The printing apparatus according to claim 4, wherein the determining unit determines the respective driving orders for the first and second printing elements, so as to match the driving blocks to which printing elements of the first and second printing elements employed to print on the same raster respectively belong.

6. The printing apparatus according to claim 1, further comprising:

a moving unit configured to move the print head in the direction crossing the predetermined direction;

a conveying unit configured to convey the print medium in the predetermined direction; and a control unit configured to control the moving unit, the conveying unit and the print head, so that at least two printing elements among the first and second printing elements are employed to print on a same raster area of the print medium.

7. The printing apparatus according to claim 6, wherein, in order to print on a predetermined area of the print medium, the control unit controls the conveying unit, the moving unit and the print head so that a time division drive method is performed while the print head is moved a plurality of times by the moving unit.

8. The printing apparatus according to claim 1, wherein the printing apparatus is configured to perform printing such that a same raster area of the print medium is printed by employing the first printing elements of the first printing element array and printing elements of another printing element array of a second print head, and wherein the determining unit determines the respective driving orders for the first printing elements of the first printing element array and the printing elements of the another printing element array of the second print head, based on a displacement between the first printing elements of the first printing element array and the printing elements of the another printing element array of the second print head in the predetermined direction.

9. The printing apparatus according to claim 1, wherein the print head includes a plurality of printing element arrays, including the first and second printing element arrays, each of the plurality of printing element arrays includes a plurality of printing elements, and wherein the determining unit determines respective driving orders for the plurality of printing elements in the plurality of printing element arrays.

10. The printing apparatus according to claim 9, wherein, for the plurality of printing element arrays of the print head, a plurality of elements of one printing element array are shifted a predetermined distance, in the predetermined direction, away from a plurality of elements of another printing element array.

11. The printing apparatus according to claim 9, wherein, for the plurality of printing element arrays of the print head, a plurality of elements of one printing element array partially overlap a plurality of printing elements of another printing element array in the direction crossing the predetermined direction.

12. The printing apparatus according to claim 1, further comprising:

a unit configured to print a test pattern for detecting a displacement, in the predetermined direction, between a first printing element of the first printing element array and a second printing element of the second printing element array employed to print on a same raster area of the print medium; and a detection unit configured to detect printing results of the test pattern, wherein the obtaining unit obtains the information based on the printing results of the test pattern detected by the detection unit.

13. The printing apparatus according to claim 1, wherein the determining unit determines the driving order for the first and second printing elements, so as to match, in the predetermined direction, print positions on the print medium by printing elements of the first and second printing element arrays employed to print on a same raster area of the print medium.

14. A method of determining respective driving orders for a print head comprising:

a first printing element array that includes first printing elements, and a second printing element array that includes second printing elements, wherein the first printing elements and the second printing elements are arranged in a predetermined direction, and the first printing element array and the second printing element array are arranged in a direction crossing the predetermined direction, and wherein the first and second printing elements are configured to be driven in respective driving orders during relative movement between the print head and a print medium in a direction crossing the predetermined direction, the method comprising the steps of:

obtaining information relating to a displacement of the first printing element array relative to the second printing element array in the predetermined direction; and determining the respective driving orders based on the displacement represented by the information obtained in the obtaining step.

15. The printing method according to claim 14, wherein a printing element of the first printing element array and a printing element of the second printing element array print on a same raster area of the print medium.

16. The printing method according to claim 14, wherein the respective driving orders for the first and second printing elements are determined, so that a difference in drive timing between printing elements of the first and second printing element arrays employed to print on a same raster area of the print medium is reduced.

17. The printing method according to claim 14, wherein the respective driving orders for the first and second printing elements are determined, so as to match, in the predetermined direction, print positions on the print medium by printing elements of the first and second printing element arrays employed to print on a same raster area of the print medium.

* * * * *